US009077075B1

(12) United States Patent
Lalezari et al.

(10) Patent No.: US 9,077,075 B1
(45) Date of Patent: Jul. 7, 2015

(54) ASYMMETRIC PLANAR RADIATOR STRUCTURE FOR USE IN A MONOPOLE OR DIPOLE ANTENNA

(71) Applicant: FIRST RF Corporation, Boulder, CO (US)

(72) Inventors: Arian C. Lalezari, Boulder, CO (US); Dean A. Paschen, Lafayette, CO (US)

(73) Assignee: FIRST RF Corporation, Boulder, CO (US)

( * ) Notice: Subject to any disclaimer, the term of this patent is extended or adjusted under 35 U.S.C. 154(b) by 219 days.

(21) Appl. No.: 13/662,477

(22) Filed: Oct. 28, 2012

(51) Int. Cl.
*H01Q 9/28* (2006.01)
*H01Q 9/16* (2006.01)
*H01Q 1/36* (2006.01)

(52) U.S. Cl.
CPC ... *H01Q 1/36* (2013.01); *H01Q 9/16* (2013.01)

(58) Field of Classification Search
USPC ..... 343/795, 793
See application file for complete search history.

(56) References Cited

U.S. PATENT DOCUMENTS

| | | | | |
|---|---|---|---|---|
| 6,028,563 | A | 2/2000 | Higgins | |
| 6,661,380 | B1 | 12/2003 | Bancroft et al. | |
| 7,019,704 | B2 | 3/2006 | Weiss | |
| 7,190,320 | B2 | 3/2007 | Okado | |
| 7,443,350 | B2 | 10/2008 | Gaucher et al. | |
| 7,542,002 | B1 | 6/2009 | Andersson | |
| 2006/0017643 | A1 * | 1/2006 | Shimasaki et al. | 343/795 |

OTHER PUBLICATIONS

Bing Li et al., Compact UWB Antennas with Dual Band-Notched Characteristics, Microwave Journal, Sep. 2012, pp. 150-160.

* cited by examiner

*Primary Examiner* — Graham Smith
(74) *Attorney, Agent, or Firm* — Christopher J. Kulish

(57) ABSTRACT

The present invention is directed to a monopole/dipole asymmetric radiator structure that includes an asymmetric planar radiator. When the asymmetric is part of an operative monopole or dipole antenna, the antenna exhibits a wide or broad bandwidth, a VSWR of less than about 3:1, a relatively constant gain perpendicular or broad-side to the plane of the radiator, and is vertically polarized. In one embodiment, asymmetric planar radiator has an outer edge that is bilaterally asymmetrical. In another embodiment, the outer edge of the asymmetric planar radiator is symmetric and a closed inner edge of the radiator that defines a void is bilaterally asymmetric.

15 Claims, 21 Drawing Sheets

ASYMMETRIC PLANAR RADIATOR STRUCTURE FOR USE IN A MONOPOLE OR DIPOLE ANTENNA

FIELD OF THE INVENTION

The present invention relates to a radiator structure that is part of a monopole or dipole radiator structure that forms an antenna.

BACKGROUND OF THE INVENTION

Generally, a monopole antenna is comprised of a radiator and a ground plane. In an ideal monopole, the radiator is disposed perpendicular to and separated from an infinite ground plane. With reference to FIGS. 1A-1C, the ideal monopole respectively exhibits a characteristic "half donut" radiation pattern 20, a characteristic two, half-circles elevational radiation pattern 22 relative to an image plane 24 (the image plane being an imaginary plane that is parallel to or coextensive with the ground plane), and a characteristic omnidirectional azimuthal radiation pattern 26 in the image plane 24. Moreover, the electrical field of the electro-magnetic wave that the antenna is capable of producing if the antenna is used to transmit a signal or capable of receiving if the antenna is used to receive a signal is vertically polarized, i.e., the electric field vector is perpendicular to the ground plane.

Generally, a dipole antenna is comprised of a pair of radiators. In an ideal dipole, the radiator structures are coplanar and separated from one another. With reference to FIGS. 2A-2C, the dipole respectively exhibits a characteristic "full donut" radiation pattern 30, characteristic two circle elevational pattern 32 relative to an image plane 34, and a characteristic omnidirectional azimuthal pattern 36 in the image plane. The electrical field of the electro-magnetic wave that the antenna is capable of producing if the antenna is used to transmit a signal or capable of receiving if the antenna is used to receive a signal is vertically polarized, i.e., the electric field vector is perpendicular to the image plane.

Two characteristics of any antenna, including monopole and dipole antennas, are the bandwidth (BW) of the antenna and the voltage standing wave ratio (VSWR) of the antenna. The bandwidth of an antenna is typically defined as the difference between the low frequency ($f_{low}$) and high frequency ($f_{high}$) at which the power output of the antenna is within 3 dB of the maximum power output of the antenna. The wavelengths associated with $f_{low}$ and $f_{high}$ respectively are $\lambda_{low}$ and $\lambda_{high}$. The VSWR is a measure of how much energy is delivered to the antenna as opposed to how much power is reflected from the antenna. Alternatively, the VSWR is a measure of how closely the antenna impedance and the impedance of the transmitter/receiver associated with the antenna are matched. A VSWR of 1:1 indicates that there is no reflected energy or that the impedances are matched.

SUMMARY OF THE INVENTION

Presently, there are several known monopole antennas that each have an asymmetric planar radiator, operate over a particular bandwidth, exhibit an acceptable VSWR over the bandwidth, are vertically polarized, and have elevational and azimuthal radiation patterns. However, these known monopole antennas each fail to exhibit a combination of: (a) at least a 3:1 bandwidth, (b) a VSWR of less than about 3:1 over the bandwidth, (c) vertical polarization, and (d) a relatively constant gain perpendicular or broad-side to the plane of the radiator. With reference to FIG. 3, an elevational radiation pattern 40 for a typical planar monopole antenna shows reduced gain perpendicular to the plane of the radiator. The radiator of the monopole lies in the perpendicular plane defined by the line extending from 0° to 180° and above the line extending between −90° and 90°, the ground plane lies in the perpendicular plane defined by the line extending between −90° and 90°. A comparison of the elevational radiation pattern for a typical monopole antenna with a planar radiator in FIG. 3 to the elevational radiation pattern for an ideal monopole antenna in FIG. 1B shows the loss in gain broadside to the plane of the radiator in the typical monopole antenna. This loss in gain is reflected in the lobing/nulling of the elevational radiation pattern. Lobing or nulling denotes a substantial drop of the radiation pattern at one or more elevational angles. Further, there are no known dipole antennas with planar radiators that exhibit the noted combination of characteristics.

The present invention is directed to a radiator structure comprising an asymmetric planar radiator. When the asymmetric radiator structure is combined with the other elements necessary to realize a monopole/dipole antenna, the resulting antenna exhibits the following operational or performance characteristics: (a) a 3:1 bandwidth, (b) a VSWR of less than about 3:1 over the bandwidth, (c) vertical polarization, and (d) a relatively constant gain perpendicular or broad-side to the plane of the radiator with any dropouts over frequency less than 6 dB.

A planar radiator is deemed to be asymmetric based on an analysis that involves: (a) defining a pseudo-ground plane and a normal plane that is perpendicular to the pseudo-ground plane, (b) positioning the planar radiator so as to be perpendicular to both the pseudo-ground plane and the normal plane, (c) positioning the planar radiator so that a pseudo-contact portion of the edge of the radiator contacts the pseudo-ground plane, the pseudo-contact portion of the portion of the edge of the planar radiator that would be closest to an infinite ground plane if the radiator were used to form a monopole antenna with an infinite ground plane, (d) positioning the planar radiator so that the normal plane passes through the mid-point of the pseudo-contact portion when the pseudo-contact portion is a straight portion of the edge or defined by a number of separated points of a combination of one or more points and one or more straight sections that are separated from one another, or through the single point that defines a pseudo-contact portion; (e) positioning the planar radiator such that the radiator is oriented to the pseudo-ground plane as the radiator would be oriented to an infinite ground plane if the radiator were used to form a monopole with an infinite ground plane. A planar radiator that is positioned relative to a pseudo-ground plane and a normal ground in this manner is considered asymmetrical if the planar radiator is bilaterally asymmetrical relative to the normal plane. The planar radiator, in addition to being asymmetrical, has an asymmetrical shape that is fundamentally responsible for producing the noted bandwidth, VSWR, vertical polarization, and the relatively constant gain broadside to the plane of the planar radiator when the planar radiator is operational in a monopole or dipole antenna.

The asymmetry of a planar radiator can be attributable to the outer edge of the radiator, a closed inner edge of the radiator that defines a void, or both an outer edge and a closed inner edge. A void is an area that is enclosed by a closed inner edge. There are numerous asymmetric shapes for a planar radiator in which the outer edge is asymmetric or at least one closed inner edge is asymmetric or both the outer edge and at least one closed inner edge is asymmetric and, when combined with the other elements needed to form a monopole/dipole antenna, result in an antenna with the noted operational performance.

Characteristics of at least a subset of the numerous planar radiators with asymmetric outer edges that when combined with the other element(s) needed to form a monopole or dipole antenna provide the noted operational performance have been identified. Before describing these characteristics, it should be appreciated that many of the asymmetric shapes that have these characteristics are superficially similar in shape to many of the currently known asymmetric planar radiators that do not result in a monopole/dipole antenna with the noted operational performance. Consequently, in some cases, the differences in shape may not appear significant but the difference in performance is substantial. The characteristics of numerous planar radiators with asymmetric outer edges that when combined with the other element(s) to form a monopole/dipole antenna with the noted operational performance are that the asymmetric shape has: (a) a width profile that has at least one wide-narrow-wide transition and (b) at least one wide-narrow-wide transition in the width profile has particular dimensional characteristics.

The concept of a width profile can be understood with respect to a relatively straight-forward example involving a planar radiator defined by an outer edge and no closed inner edge (i.e., the radiator does not enclose a void). If there is no horizontal line parallel to the pseudo-ground plane that can be drawn through the planar radiator that passes through a gap between two portions of the radiator, a width profile is the plotting of the horizontal width (on a vertical axis) versus the vertical location relative to the pseudo-ground plane beginning at the point or points on the outer edge that is/are farthest from the pseudo ground plane and proceeding to the pseudo contact portion (on a horizontal axis) or vice-versa. If the width profile yields at least one local minimum located in between two local maximums, the radiator has a wide-narrow-wide transition in the width profile.

The dimensional characteristics are: (a) a vertical distance between a local minimum and the vertically closest of the local maximum on one side of the local minimum and the local maximum on the other side of the local minimum and (b) a horizontal distance between a local minimum and the horizontally closest of the local maximum on one side of the local minimum and the local maximum on the other side of the local minimum. If the vertical distance associated with at least one local minimum is at least 0.02 of the wavelength associated with the frequency that defines the low end of the bandwidth ($\lambda_{low}$) and the horizontal distance associated with the local minimum is at least $0.01\lambda_{low}$, the radiator satisfies the dimensional requirement. A planar radiator that satisfies the wide-narrow-wide and dimensional requirements is sufficiently asymmetric to realize the noted benefits.

There are numerous planar radiators with asymmetric shapes that, when combined with the other element(s) needed to form a monopole or dipole antenna, result in an antenna with the noted performance but that do not have the wide-narrow-wide and dimensional characteristics. However, it has been determined that a modification to a raw or unmodified width profile associated with some of these asymmetric shapes will produce a modified width profile that has the characteristics of an asymmetric radiator that will function in the desired manner. In other words, the modified profile reflects the reality that planar radiators with these asymmetric shapes will function as desired. The modification recognizes that certain features of some these asymmetric shapes causes the shape to fail to have one or more the required characteristics. Among these features are: (a) an outer edge with at least one small amplitude ripple that causes the radiator to not satisfy the vertical dimension characteristic, (b) an outer edge with at least one ripple and surrounding structure that causes the radiator to not satisfy the horizontal dimension characteristic, and (c) an outer edge with at least one right angle bend. In the case of a small amplitude ripple, the vertical distance between each local minimum that correlates to the ripple and the vertically nearest local maximum of the two local maximums that bracket each such local minimum may be insufficient, but the vertical distance between the same local minimum and a different local maximum does satisfy the requirement. In the case of a ripple and surrounding structure that cause the radiator to not satisfy the horizontal dimension characteristic, the horizontal distance between each local minimum and the horizontally nearest local maximum of the two local maximums that bracket the local minimum may be insufficient, but the horizontal distance between the same local minimum and a different local maximum may satisfy the requirement. With respect to both of these ripple structures, the ripple essentially does not have a significant adverse effect on whether the asymmetric shape facilitates the noted performance in a monopole/dipole antenna but does cause the asymmetric shape to fail to have one of the characteristics. In the case of an outer edge with at least one right angle bend, such bends can result in a width profile with horizontal and/or vertical sections that can make it impossible to determine the location of a local maximum or local minimum. A common characteristic of asymmetric shapes that have one or a combination of these characteristics is that each of these characteristics presents, from a Fourier analysis perspective, high frequency components in the unmodified width profile. If the unmodified width profile is analyzed to determine the first harmonic and then the unmodified width profile is filtered so as to pass substantially only the first harmonic identified by the Fourier analysis, a modified width profile is produced that exhibits the wide-narrow-wide and dimensional characteristics. The filtering produces a modified width profile that reflects the "essence" of the asymmetric shape. It should be appreciated that an asymmetric shape with a width profile that does not exhibit one of the characteristics due only to the presence of right angle bends in the outer edge can be filtered in a different fashion. For example, the mid-points of horizontal sections can be defined as local minimums or local maximums.

The width profile that is ultimately assessed to determine whether the wide-narrow-wide and dimensional characteristics are present is occasionally referred to herein as the assessment width profile and can be the original width profile for an asymmetric radiator or a modified width profile that reflects a modification to the outer edge of the radiator and/or some kind of processing of the original width profile to produce a modified width profile.

There is another group of asymmetric shapes that, when combined with the other element(s) needed to form a monopole or dipole antenna, result in an antenna with the noted performance but that do not have the wide-narrow-wide and dimensional characteristics. Characteristic of this group of asymmetric shapes is a downwardly extending protuberance, sometimes referred to as a "stalactite". When such a protuberance is present, a horizontal line can be drawn that extends through a gap between the protuberance and another portion of the radiator. Further, there is a local inflection point in the planar radiator located above the portion of the horizontal line extending through the gap. A local inflection point is a point on the outer edge that has a zero slope. Further, the portion of the outer edge immediately to one side of the point has a positive slope, the portion of the outer edge immediately to the other side has a negative slope, and there is a portion of the radiator that is located immediately above the inflection point. The presence of the gap forecloses the possibility of producing a width profile for the planar radiator and, because a width profile cannot be produced, determining whether the radiator has the characteristics of a asymmetric radiator that, when combined with the other element(s) needed to form a monopole or dipole antenna, produces the noted operational performance. To address this issue, the outer edge of the planar radiator is redefined. The redefined outer edge is then used to produce a modified width profile relative to the width profile before the outer edge was redefined. The modified width profile satisfies the characteristics of an asymmetric radiator that will have the noted performance characteristics. In other words, the modified width profile reflects the reality that planar radiators with these asymmetric shapes that have a downwardly extending protuberance will function as desired. The redefined outer edge is produced by drawing a horizontal line through the local minimum associated with the protuberance. The portion of the horizontal line that spans a gap to either side of the local minimum replaces the portion of the outer edge of the planar radiator that extends between the local minimum and the point/points at which the portion of the horizontal line spans the gap/gaps. In the case of several protuberances being present in the asymmetrical shape and two or more horizontal lines crossing a specific gap, the portion of the horizontal line closest to the pseudo-ground plane prevails in the redefined outer edge.

There is yet another group of asymmetric shapes that, when combined with the other element(s) needed to form a monopole or dipole antenna, result in an antenna with the noted performance but that do not have the wide-narrow-wide and dimensional characteristics. Characteristic of this group of asymmetric shapes are at least two upwardly extending protuberances, sometimes referred to as "stalagmites." When such protuberances are present, a horizontal line can be drawn that extends through a gap between at least two of the protuberances. Further, there is a local minimum in the outer edge of the planar radiator located below the portion of the horizontal line extending through the gap. The presence of the gap forecloses the possibility of producing a width profile for the planar radiator and, because a width profile cannot be produced, determining whether the radiator has the characteristics of an asymmetric radiator that, when combined with the other element(s) needed to form a monopole or dipole antenna, result in an antenna with the noted operational performance. This type of gap also reflects that there functionally are at least two radiator elements present in the single planar radiator. Further, since a monopole/dipole antenna with this type of planar radiator exhibits the noted operational performance, at least one of the radiator elements satisfies the characteristics needed of an asymmetric radiator that will provide the noted performance characteristics in an operational situation. Each radiator element is defined by "horizontal shading" that begins at a local maximum in the planar radiator and extends to the pseudo-contact point. Horizontal shading can be conceptualized as defining an area (in this case, the area of an element) by drawing a series of horizontal lines beginning at the local maximum and moving downward towards the pseudo-contact point with the requirement that no horizontal line can cross a gap. The areas of the elements identified in this manner will have overlapping portions because the area associated with each element must terminate at the pseudo-contact point. Each of the identified radiator elements is then used to produce a width profile. The width profile for at least one of these elements has the characteristic of an asymmetric radiator that will operationally have the noted performance characteristics. In other words, the modification reflects that certain asymmetric radiators with two or more upwardly extending protuberances operationally provide the noted performance characteristics.

There is yet another group of asymmetric shapes that, when combined with the other element(s) needed to form a monopole or dipole antenna, result in an antenna with the noted performance but that do not have the wide-narrow-wide and dimensional characteristics. This group of asymmetric shapes has a combination of features that make problematic the assessment of whether the characteristics needed for the noted operational performance are present.

One of these asymmetric shapes has at least one downwardly extending protuberance and at least a portion of the outer edge has a characteristic that requires filtering (e.g., a small amplitude ripple). In this case, the outer edge is redefined to eliminate the downwardly extending protuberance, a modified width profile is produced for the asymmetric shape with the redefined outer edge, and a modified-modified width profile is produced by filtering the modified width profile. The modified-modified width profile reflects that the asymmetric shape has the characteristics needed to operationally have the required performance.

Another one of these asymmetric shapes has at least one downwardly extending protuberance and at least two upwardly extending protuberances. In this case, the outer edge is redefined to eliminate the downwardly extending protuberance, the radiator elements are identified with horizontal shading, and modified width profiles are produced for each of the radiator elements. At least one of the modified width profiles reflects that the asymmetric shape has the characteristics needed to operationally have the required performance. The width profiles for the elements are referred to as modified width profiles because neither of these profiles is a width profile for the actual asymmetric shape of the radiator.

Yet another of the asymmetric shapes has at least one downwardly extending protuberance, at least two upwardly extending protuberances, and at least a portion of the outer edge has a characteristic that requires filtering. In this case, the outer edge is redefined to eliminate the downwardly extending protuberance, the radiator elements are identified with horizontal shading, a modified width profile is produced for each of the identified elements, and a modified-modified width profile is produced for each of the elements that has a shape for which filtering of the width profile is appropriate. At least one of any of the modified and the modified-modified width profiles reflects that the asymmetric shape has the characteristics needed to operationally have the required performance.

An additional one of these asymmetric shapes has at least two upwardly extending protuberances and at least a portion of the outer edge has a characteristic that requires filtering. In this case, the radiator elements are identified by horizontal shading, a modified width profile is produced for each of the elements, and a modified-modified width profile is produced for each of the elements that has a shape for which filtering of the width profile is appropriate. At least one of any of the modified and modified-modified width profiles reflects that the asymmetric shape has the characteristics needed to operationally have the required performance.

An asymmetric planar radiator that facilitates the noted performance in a monopole/dipole antenna can also be achieved with a planar radiator having a symmetric outer edge and an asymmetric void in the radiator. A void is defined by a closed edge. As such, the radiator completely surrounds the void. In one embodiment, the outer edge is symmetric but the inner edge is asymmetric. In another embodiment, both the outer edge and the inner edge are each asymmetric. In yet another embodiment, the outer edge is asymmetric and the inner edge is symmetric. In any event, the assessment of whether an asymmetric radiator with a void is sufficient for realizing the noted performance is done by producing a width profile in which the presence of the void is not ignored. In this case, the width at a vertical location at which a horizontal line passes through the void is the sum of the "sub-widths" of the portions of the radiator present on each side of the void. The width profile is assessed to determine whether the noted wide-narrow-wide and dimensional characteristics are present.

DETAILED DESCRIPTION

Generally, the invention is directed to an asymmetrical planar radiator for use in a monopole/dipole antenna that performs so as to have: (a) at least a 3:1 bandwidth, (b) a VSWR of less than about 3:1 over the bandwidth, (c) vertical polarization, and (d) a relatively constant gain perpendicular or broad-side to the plane of the radiator with any dropouts over frequency less than 6 dB. This operational performance for such monopole/dipole antennas is substantially attributable to the asymmetric radiator.

Figure 1A:
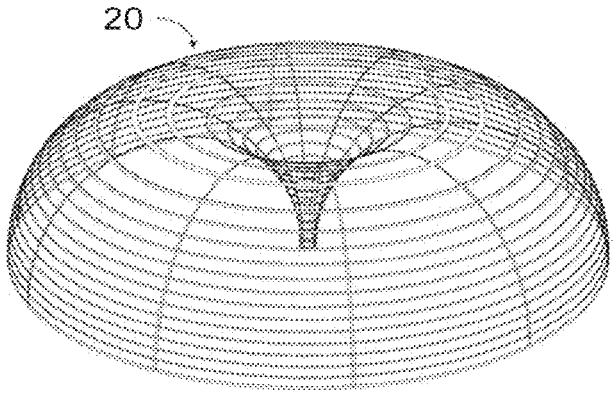
FIGS. 1A-1C respectively illustrate the "half donut" radiation pattern, elevational radiation pattern, and azimuthal radiation pattern associated with an ideal monopole antenna.
Figure 1B:
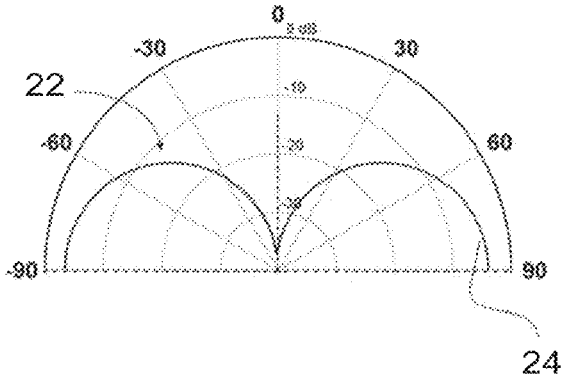
Figure 1C:
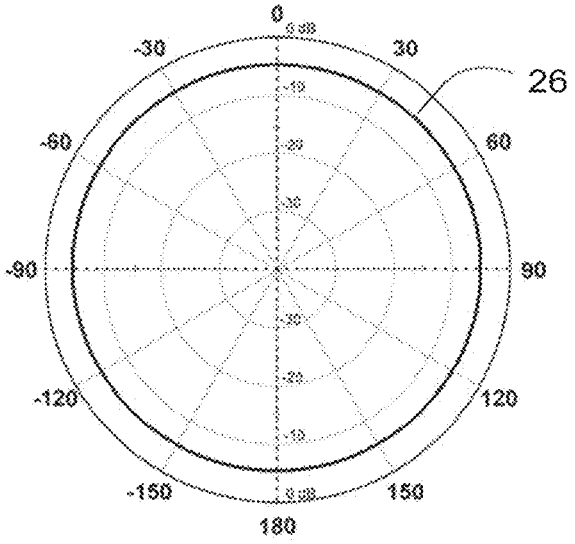
Figure 2A:
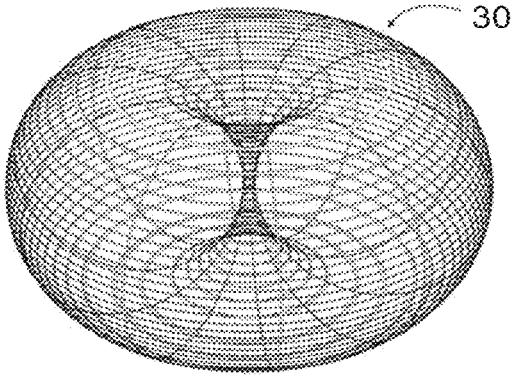
FIGS. 2A-2C respectively illustrate the "full donut" radiation pattern, elevational radiation pattern, and azimuthal radiation pattern associated with an ideal dipole antenna.
Figure 2B:
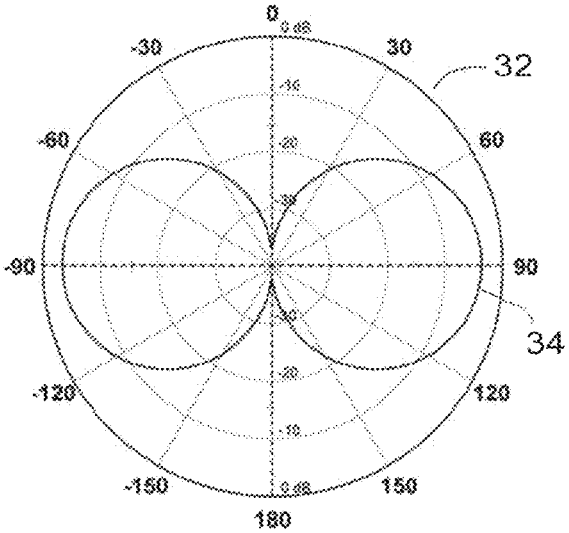
Figure 2C:
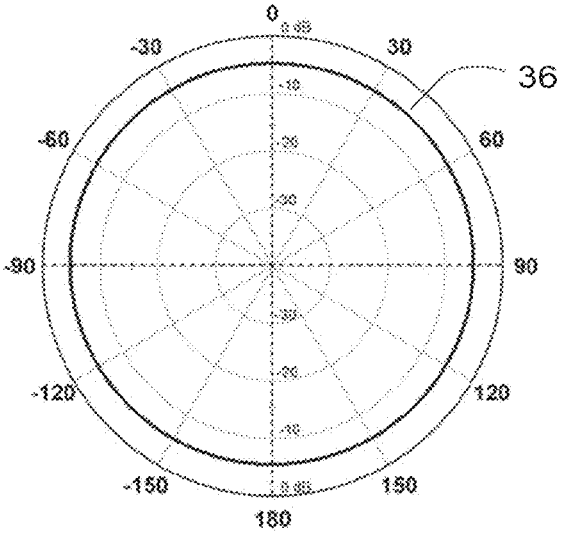
Figure 3:
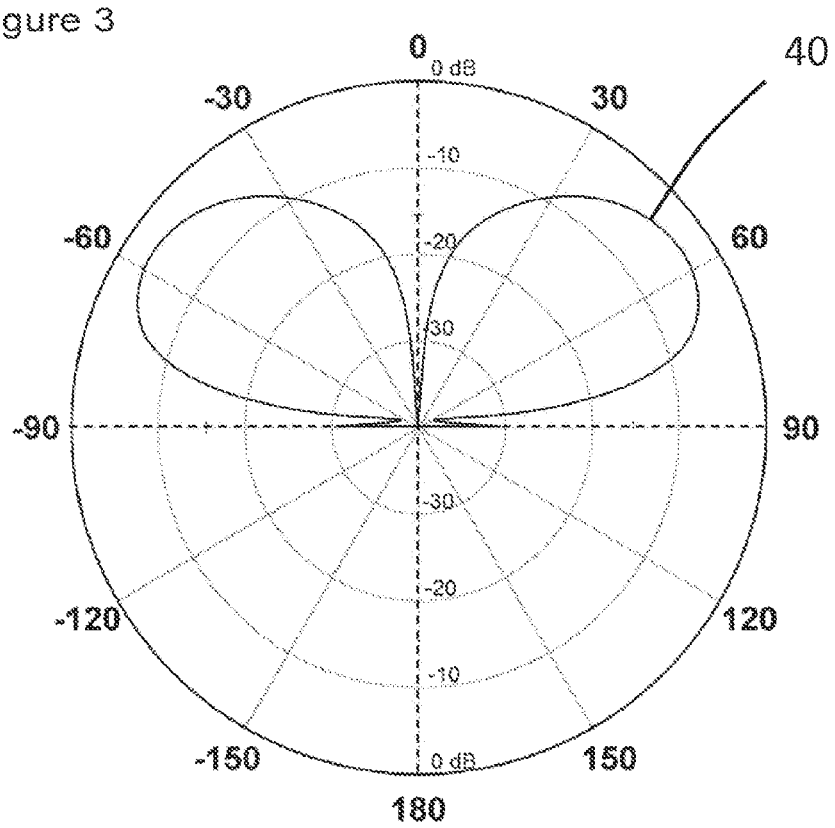
FIG. 3 is an example of an elevational radiation pattern for a known planar monopole antenna that illustrates reduced gain perpendicular to the plane of the radiator, the reduced gain is reflected in the lobing/nulling present in the pattern.
Figure 4A:
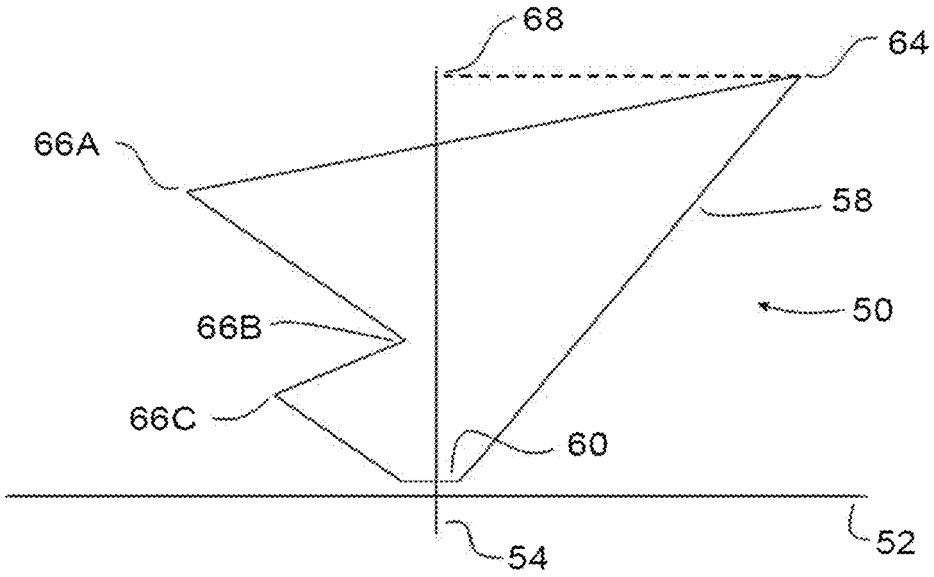
FIG. 4A illustrates a planar radiator positioned relative to a pseudo-ground plane and a normal plane in a manner that allows a determination of whether the radiator is asymmetric.

It has been determined that there are numerous asymmetrical shapes for a planar radiator in a monopole/dipole antenna that result in the antenna having the noted performance. Further, the characteristics of such asymmetric planar radiators have been identified. One of the characteristics of a planar radiator for an antenna that will have the noted performance is that the planar radiator is asymmetrical. With reference to FIG. 4A, this characteristic is discussed with respect to an exemplary planar radiator 50. Whether radiator 50 is asymmetric is determined relative to a pseudo-ground plane 52 and a normal plane 54 that is perpendicular to the pseudo-ground plane 52. The pseudo-ground plane 52 is a plane that is located parallel to where an ideal ground plane would be located if the radiator 50 were used in a monopole antenna having an ideal ground plane. As such the pseudo-ground is not a real ground plane. The pseudo-ground is simply a reference plane that facilitates a determination of asymmetry. The radiator 50 includes an outer edge 58 that defines the overall shape of the radiator 50. The outer edge 58 includes a pseudo-contact portion 60 that contacts the pseudo-ground plane 52 and is the portion of the radiator 50 that would be closest to an ideal ground plane if the radiator were used in a monopole antenna with an ideal ground plane. The pseudo-contact portion 60 of the radiator 50 is illustrated as extending along a straight line. It should be appreciated that a pseudo-contact portion 60 is not limited to a straight line but can be a single point, a number of separated points, or a combination of one or more points and one or more straight sections that are separated from one another. The radiator 50 is positioned such that the mid-point of the pseudo-contact portion 60 is intersected by the normal plane 54. If the pseudo-contact portion is a point, the mid-point of the pseudo-contact portion is the point. If the pseudo-contact portion is comprised of a number of separated points or a combination of one or more points and one or more straight sections that are separated from one another, the mid-point is the point that is mid-way between the two most separated points of the pseudo-contact portion. The radiator 50 is also positioned such that the entire radiator, other than the pseudo-contact portion 60, is entirely located to one side of the pseudo-ground plane 52. Additionally, the radiator 50 is oriented to the pseudo-ground plane 52 as the radiator 50 would be oriented, if used in a monopole antenna, relative to an ideal ground plane. With the planar radiator 50 positioned relative to the pseudo-ground plane 52 and normal ground plane in this manner, the asymmetry of the radiator 50 is judged by whether the radiator is bilaterally asymmetrical relative to the normal plane 54. The planar radiator 50 is bilaterally asymmetric relative to the normal plane 54. Consequently, the planar radiator 50 is an asymmetric planar radiator.

Numerous monopole/dipole antennas that employ an asymmetric planar radiator exhibit the noted operational performance. An additional group of characteristics of the asymmetric planar radiators employed in monopole/dipole antennas that exhibit the noted performance has been identified. These characteristics are: (a) a width profile that has at least one wide-narrow-wide transition and (b) at least one wide-narrow-wide transitions in the width profile has particular dimensional characteristics. A width profile is a graph of the horizontal width of the radiator from the point(s) of the radiator that are most distant from the pseudo-ground plane to the pseudo-contact portion or visa-versa. Width is on the vertical axis of the graph and vertical position is on the horizontal axis with the zero location on the horizontal axis corresponding to the point of the radiator that is most distant from the pseudo-ground plane. It should be appreciated that the graph could be done with the zero location on the horizontal axis corresponding to the pseudo-contact portion. The width profile is described from the perspective of moving from the zero location on the horizontal axis towards the location on the horizontal axis that corresponds to the pseudo-contact portion.

A wide-narrow-wide transition is expressed in the graph by a local minimum situated between two local maximums. A profile local minimum has a zero slope with the immediately preceding portion of the graph having a negative slope (i.e., the portion towards the zero location on the horizontal axis) and the immediately following portion of the graph having a positive slope. A profile local maximum has a zero slope. The portion of a graph that immediately precedes a profile local maximum that is not associated with either of the point(s) of the planar radiator that is/are most distant from the pseudo-ground plane or the pseudo-contact portion has a positive slope (i.e., the portion towards the zero location on the horizontal axis) and the portion of the graph that immediately follows the profile local maximum has a negative slope. If a profile local maximum is associated with the point of the planar radiator that is most distant from the pseudo-contact plane, the profile local maximum has a zero slope and the portion of the graph immediately following the profile local maximum has a negative slope. If a profile local maximum is associated with the pseudo-contact portion, the profile local maximum has a zero slope and the portion of the graph immediately preceding the profile local maximum has a positive slope.

Figure 4B:
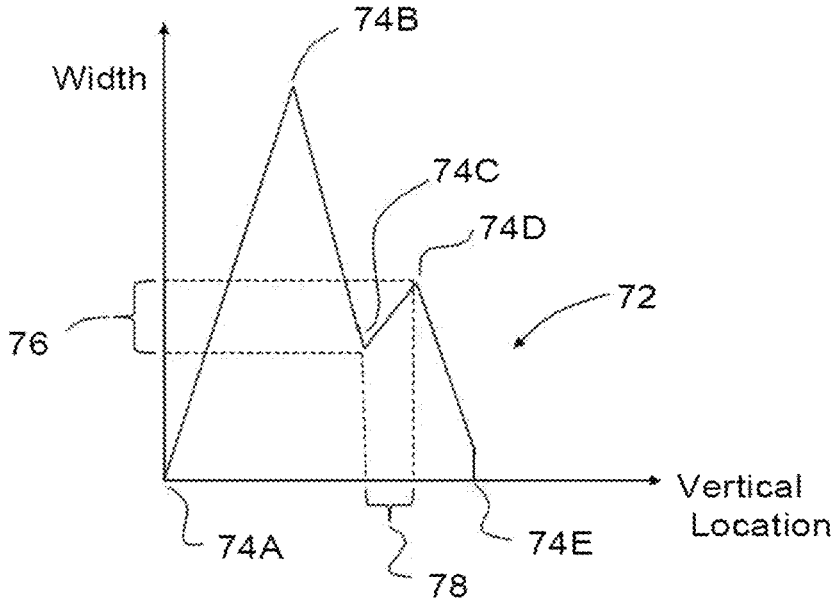
FIG. 4B illustrates the width profile for the asymmetrical planar radiator illustrated in FIG. 4A.

With reference to FIGS. 4A and 4B, the wide-narrow-wide characteristic is described with respect to the exemplary, asymmetric planar radiator 50. The outer edge 58 of the radiator 50 includes a member local maximum 64 and transition points 66A-66C located between the member local maximum 64 and the pseudo-contact portion 60. A member local maximum is a point or a horizontal extending line on the outer edge where the portions of the outer edge immediately to each side of the member local maximum extend towards the pseudo-ground plane. With respect to radiator 50, the member local maximum 64 is also the point most distant from the pseudo-ground plane 52. As such, the member local maximum 64 defines point 68, the point on the line defined by the intersection of the normal plane 54 and asymmetric planar radiator 50 that will correspond to the zero point on the horizontal axis of the width profile.

With reference to FIG. 4B, a width profile 72 for the radiator 50 is illustrated. The width profile has points 74A-74E that respectively correspond to the horizontal widths of the radiator 50 associated with points 64, 66A, 66B, 66C, and 60 of the radiator 50. The width profile 72 reveals a wide-narrow-wide transition defined by the profile local minimum 74C located between the two profile local maximums 74B and 74D.

The particular dimensional characteristics are: (a) a vertical distance between a profile local minimum and the vertically closest of the profile local maximum immediately to one side of the profile local minimum and the profile local maximum immediately to the other side of the local minimum and (b) a horizontal distance between a profile local minimum and the horizontally closest of the profile local maximum immediately to one side of the local minimum and the profile local maximum immediately to the other side of the profile local minimum. If the vertical distance associated with at least one profile local minimum is at least 0.02 of the wavelength associated with the frequency that defines the low end of the bandwidth ($\lambda_{low}$) and the horizontal distance associated with the same profile local minimum is at least $0.01\lambda_{low}$, the radiator satisfies the dimensional requirement. A planar radiator that satisfies the wide-narrow-wide and dimensional requirements is sufficiently asymmetric to realize the noted benefits.

With reference to FIG. 4B, the width profile 72 for the radiator 50 shows the profile local maximum 74D to be vertically closer to the profile local minimum 74C than the profile local maximum 74B. The vertical distance between the profile local minimum 74D and the profile local maximum 74D is represented by distance 76 along the vertical axis of the graph of the width profile 72. The width profile 72 for the radiator 50 also shows the profile local maximum 74D to be horizontally closer to the profile local minimum 74C than the profile local maximum 74B. The horizontal distance between the profile local minimum 74D and the profile local maximum 74D is represented by distance 78 along the horizontal axis of the graph of the width profile 72. If the vertical and horizontal distances associated with the profile local minimum 74C respectively are at least $0.02\lambda_{low}$ and $0.01\lambda_{low}$, the radiator 50 satisfies the dimensional characteristics.

There are numerous planar radiators with asymmetric shapes that, when combined with the other element(s) needed to form a monopole or dipole antenna, result in an antenna with the noted performance but that do not have the wide-narrow-wide and dimensional characteristics. However, it has been determined that a modification to a raw or unmodified width profile associated with some of these asymmetric shapes will produce a modified width profile that has the characteristics of an asymmetric radiator that will function in the desired manner. In other words, the modified profile reflects the reality that planar radiators with these asymmetric shapes will function as desired. The modification recognizes that certain features of some these asymmetric shapes causes the shape to fail to have one or more the required characteristics.

Figure 5A:
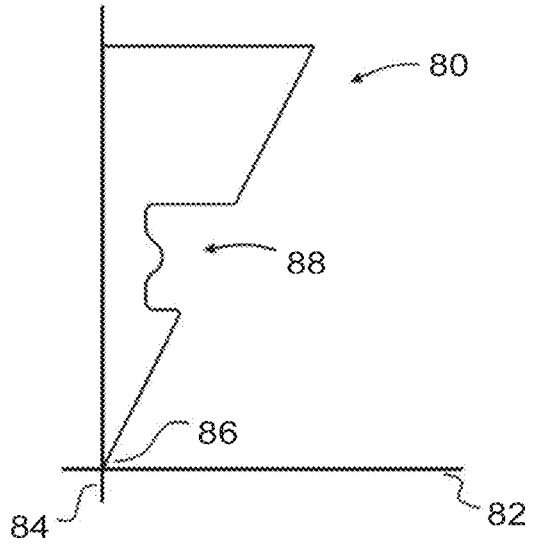
FIGS. 5A-5C respectively illustrate an asymmetric planar radiator with an outer edge that has a small amplitude ripple that causes the radiator to not have a vertical dimensional characteristic, a width profile for the radiator, and a modified width profile.
Figure 5B:
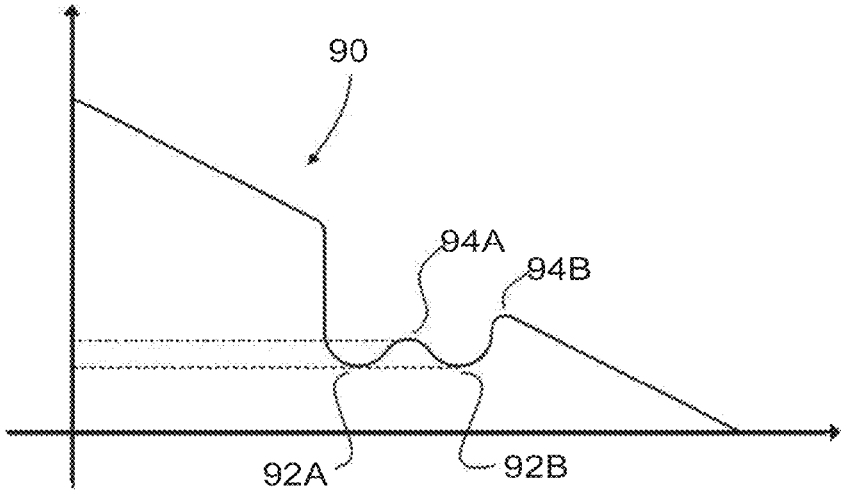
Figure 5C:
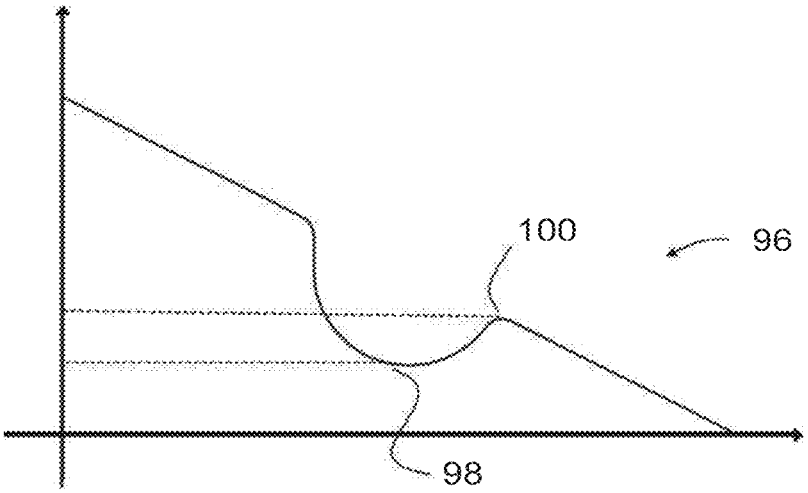

Among these features is an outer edge of an asymmetric planar radiator with at least one small amplitude ripple. The presence of the small amplitude ripple results in the radiator not having the characteristic vertical dimension. To elaborate, if the only profile local minimums associated with the width profile of an asymmetric planar radiator are associated with a ripple and the ripple has a small amplitude, the vertical distance between any such profile local minimums and the vertically nearest profile local maximum of the two profile local maximums that bracket the local minimum may be insufficient. With reference to FIGS. 5A-5C, an example of such an asymmetric planar radiator 80 is discussed. The planar radiator 80 is positioned such that: (a) the radiator 80 is perpendicular to a pseudo-ground plane 82 and a normal plane 84, (b) a pseudo-contact portion 86 of the radiator 80 contacts the pseudo ground plane 82; (c) the normal plane 84 passes through the midpoint of the pseudo-contact portion 86 (a single point in this example); (d) the radiator 80, other than the pseudo-contact portion 86 is located entirely to one side of pseudo-ground plane 82, and (e) the radiator 80 is oriented relative to the pseudo-ground plane as the radiator would be oriented, in a monopole antenna, to an idealized infinite ground plane. The radiator 80 is bilaterally asymmetrical relative to the normal plane 84. Further, a portion 88 of the outer edge of the radiator exhibits a low amplitude ripple 88.

With reference to FIG. 5B, the planar radiator 80 has a width profile 90. The width profile has two profile local minimums 92A-92B and two profile local maximums 94A-94B. At least the two profile local minimums 92A-92B and the profile local maximums 94A can be correlated to the ripple 88. With respect to the horizontal dimension characteristic and for purposes of illustration, both the profile local minimum 92A and the profile local minimum 92B satisfy the characteristic.

With respect to the vertical dimension characteristic, the vertically closest of the profile local maximums to each of the profile local minimums 92A-92B is the profile local maximum 94A. The vertical distance associated with each of the profile local minimums is less than $0.022\lambda_{low}$. As such, the radiator does not possess the vertical dimensional characteristic associated with asymmetric planar radiators that have the noted operational performance. However, the radiator does have the noted operational performance. It has been discovered that a low-amplitude ripple in a width profile that corresponds to a ripple in the outer edge of the radiator has, from a Fourier analysis perspective, high frequency components. Further, it has been discovered that by performing a Fourier analysis of a width profile, these high frequency components can be identified and the width profile filtered to eliminate these high frequency components and thereby produce a modified width profile that reflects the "essence" of the shape of the radiator that facilitates the operational performance of the radiator in an antenna. More specifically, the Fourier analysis of a width profile is performed to identify the first harmonic of the Fourier frequency spectrum for the profile. The width profile is then filtered so as to pass substantially only the first harmonic and thereby produce a modified width profile in which the low amplitude ripple has been substantially eliminated, thereby allowing a new profile local minimum to be assessed for the noted horizontal and vertical dimensional characteristics. With respect to the width profile 90, this modification produces a modified width profile 96 having a profile local minimum 98 and a profile local maximum 100. The profile local minimum now satisfies both the horizontal and vertical dimensional characteristics of a radiator that, when in operation, facilitates the noted performance.

Figure 6A:
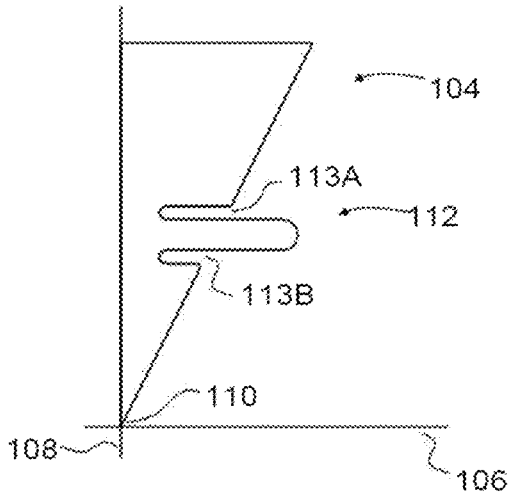
FIGS. 6A-6C respectively illustrate an asymmetric planar radiator with an outer edge with a large amplitude ripple and narrow slots that separate the ripple from adjacent portions of the radiator that causes the radiator to not have a horizontal dimensional characteristic, a width profile for the radiator, and a modified width profile.
Figure 6B:
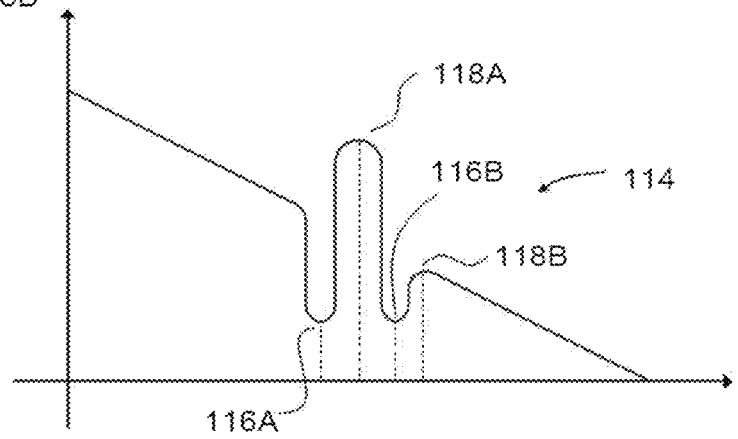
Figure 6C:
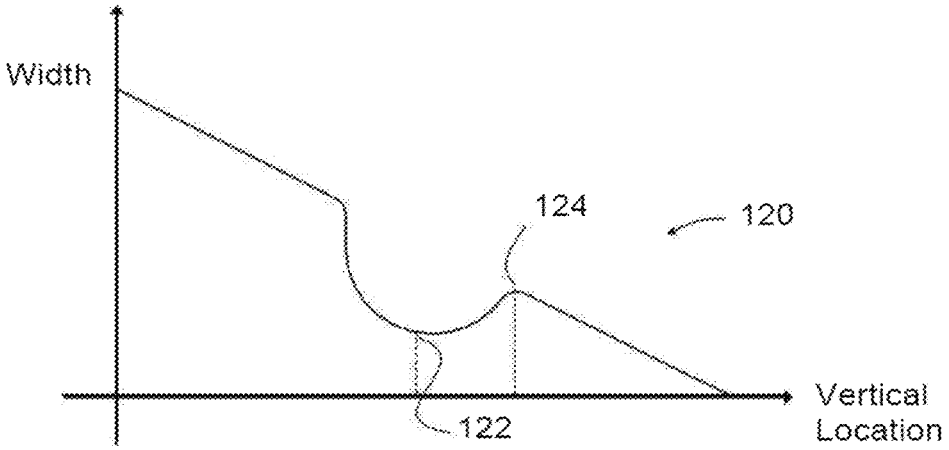

Also among the features that can cause an asymmetrical shape to fail to have one or more of the required characteristics is an outer edge of an asymmetric planar radiator with at least one ripple and surrounding structure that cause the radiator to lack the horizontal dimension characteristic. To demonstrate this type of ripple and surrounding structure, the ripple is assumed to have a relatively large amplitude that results in the vertical dimensional characteristic being satisfied for the local minimums located immediately adjacent to the ripple. The ripple is also narrow and bracketed by portions of the radiator that are separated from the ripple by relatively narrow slots. This type of structure produces a width profile with profile local minimums that satisfy the vertical dimension characteristic. However, due to the horizontal closeness of each of the profile local minimums to a profile local maximum, the radiator does not satisfy the horizontal dimensional characteristic. With reference to FIGS. 6A-6C, an example of such an asymmetric planar radiator 104 with such a feature is discussed. In this regard, the planar radiator has an outer edge with a ripple 112 that is separated by narrow slots 113A, 113B from surrounding portions of the radiator. The planar radiator 104 is positioned relative to a pseudo-ground plane 106 and a normal plane 108 so as to be able to assess whether the radiator 104 is asymmetric. In this regard, a pseudo-contact portion 110 of the radiator 104 is positioned to contact the pseudo-ground plane 106. As can be appreciated, the radiator 104 is bilaterally asymmetric relative to the normal plane 108 and, hence, considered to have the asymmetric characteristic. With reference to FIG. 6B, the planar radiator 104 has a width profile 114. Associated with the width profile 114 are profile local minimums 116A, 116B and local profile local maximums 118A, 118B. Associated with each of the profile local minimums 116A, 116B is a vertical dimension that is at least $0.02\lambda_{low}$. As such, the only two profile local minimums in the width profile 114, profile local minimums 116A, 116B, each satisfy the vertical dimension characteristic. However, neither of the profile local minimums 116A, 116B satisfies the horizontal dimensional characteristic, i.e., neither of the profile local minimums is separated from the horizontally nearest profile local maximum by at least $0.01\lambda_{low}$. However, the radiator 104 does have the noted operational performance. The Fourier based filtering addresses this issue. In the case of the width profile 114, the Fourier based filtering results in a modified width profile 120, as shown in FIG. 6C. The modified width profile 120 has a single profile local minimum 122 and a profile local maximum 124. Using the profile local minimum 122 and the profile local maximum 124, the horizontal dimensional characteristics is satisfied and the vertical dimensional characteristic remains satisfied.

Figure 7A:
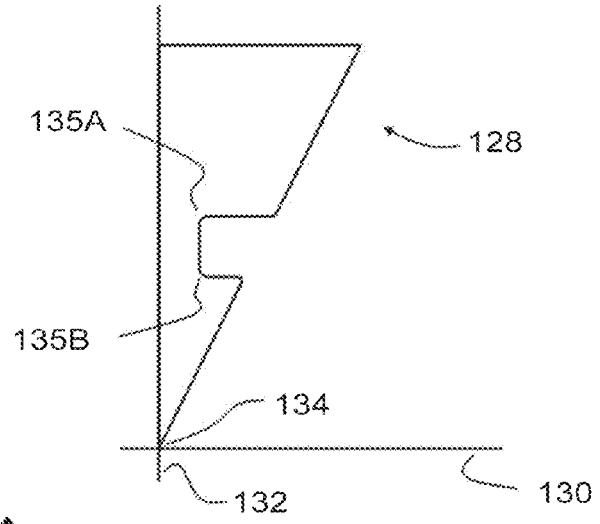
FIGS. 7A-7C respectively illustrate an asymmetric planar radiator with an outer edge that has two right angle bends that render difficult the assessment of whether the radiator has a dimension characteristic, a width profile for the radiator, and a modified width profile.
Figure 7B:
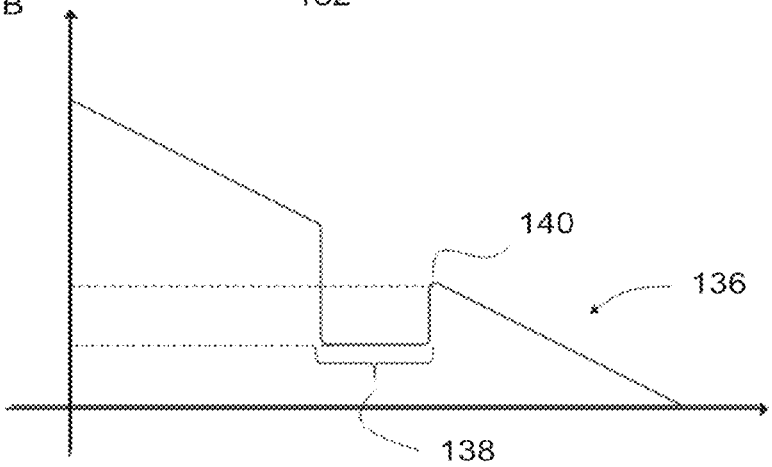
Figure 7C:
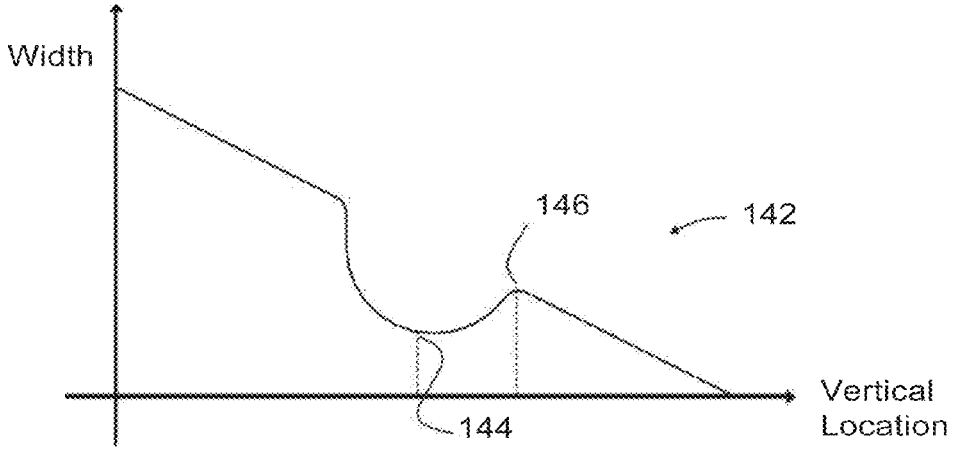

Also among the features that can cause an asymmetrical shape to fail to have one or more of the required characteristics is an outer edge of an asymmetric planar radiator with at least right angle corner that makes the determination of the location of a profile local maximum or profile local minimum impossible and, as such, assessment of dimensional characteristics impossible. With reference to FIGS. 7A-7C, an example of such an asymmetric planar radiator 128 with two such features is discussed. In this regard, the planar radiator has an outer edge with first and second ninety-degree corners 135A, 135B. The planar radiator 128 is positioned relative to a pseudo-ground plane 130 and a normal plane 132 so as to be able to assess whether the radiator 128 is asymmetric. In this regard, a pseudo-contact portion 134 of the radiator 128 is positioned to contact the pseudo-ground plane 130. As can be appreciated, the radiator 128 is bilaterally asymmetric relative to the normal plane 132 and, hence, considered to have the asymmetric characteristic. With reference to FIG. 7B, the planar radiator 128 has a width profile 136. Associated with the width profile 136 is an "indeterminate" profile local minimum that is somewhere in the area 138 and local profile local maximum 140. The indeterminate local minimum in area 138 allows a determination of whether the vertical dimension characteristic is satisfied. For purposes of illustration, it is assumed that the vertical dimension characteristic is present. However, the indeterminate local minimum does not sufficiently identify a particular point that can be used to assess whether the horizontal dimension characteristic is present in the radiator. The Fourier based filtering addresses this issue. In the case of the width profile 136, the Fourier based filtering results in a modified width profile 142, as shown in FIG. 7C. The modified width profile 142 has a single profile local minimum 144 and a profile local maximum 146. Using the profile local minimum 144 and the profile local maximum 146, the horizontal dimensional characteristics is satisfied and the vertical dimensional characteristic remains satisfied.

It should be appreciated that there potentially are other features and/or combinations of features associated with outer edge of an asymmetric radiator that provides the operational performance but that causes the radiator to fail to have a dimensional characteristic and/or make difficult the identification of a profile local maximum or profile local minimum that can be addressed by Fourier filtering or some other type of filtering.

There is a group of asymmetric planar radiators with shapes that, when combined with the other element(s) needed to form a monopole or dipole antenna, result in an antenna with the noted performance but render assessment of whether the radiator shape satisfies the wide-narrow-wide characteristic problematic. The feature common to this group of asymmetric radiator shapes is a downwardly (towards the pseudo-ground plane) extending protuberance. Characteristic of such a protuberance is that a horizontal line (i.e., a line parallel to the pseudo-ground plane) can be drawn that passes through a first portion of the radiator, a second portion of the radiator, and a gap between the first and second portions of the radiator. Further, there is a local minimum in the outer edge that is associated with the protuberance. This local minimum is sometimes referred to as a member local minimum to distinguish this local minimum from a profile local minimum in a width profile. The member local minimum has a zero slope, space below and immediately adjacent to the minimum, a portion of the radiator located above the minimum, and the outer edge extends upward (away from the pseudo-ground plane) to both sides of the minimum. Also characteristic of the downwardly extending protuberance is a member inflection point located above the horizontal line. A member inflection point has zero slope, space below and immediately adjacent to the inflection point, a portion of the radiator located above the inflection point, and the outer edge extends downwardly (towards the pseudo-ground plane) on both sides of the inflection point.

The problem in assessing the wide-narrow-wide characteristic in asymmetric planar radiators that have a downwardly extending protuberance is addressed by redefining the outer edge of the radiator. More specifically, the outer edge is redefined by extending a horizontal line through the member local minimum associated with the protuberance. The horizontal line will intersect the outer edge of the radiator at one or more locations to one side of the member local minimum and potentially at one or more locations to the other side of the member. The outer edge is redefined such that, in moving in one direction from the member local minimum, the portion of the horizontal line extending from the member local minimum to the intersection point on the outer edge that is closest (as measured along the outer edge) to the member local minimum replaces the existing outer edge between the member local minimum and the intersection point. If the horizontal line (moving in the other direction) also intersects the outer edge, the outer edge is further redefined such that the portion of the horizontal line extending from the member local minimum to the closest intersection point (as measured along the outer edge) replaces the current portion of the outer edge extending between these two points.

Figure 8A:
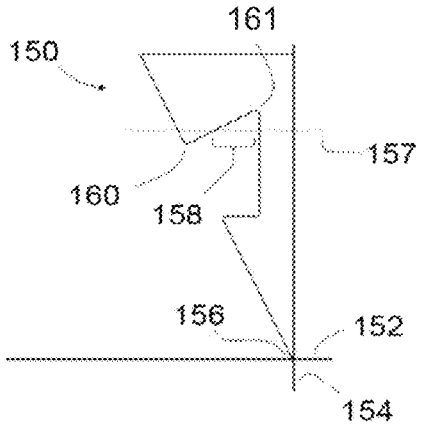
FIGS. 8A-8C respectively illustrate an asymmetric planar radiator with an outer edge that has a "stalactite" that makes the assessment of whether the radiator has a wide-narrow-wide characteristic difficult, a modified asymmetric planar radiator that has a modified outer edge relative to the unmodified asymmetric planar radiator, and a modified width profile.
Figure 8B:
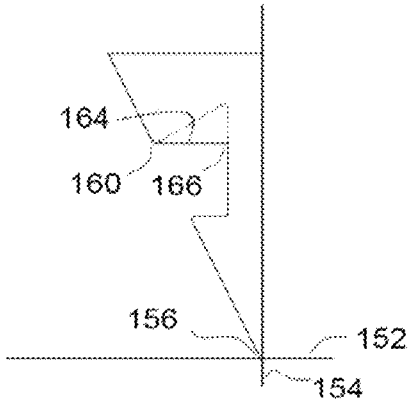
Figure 8C:
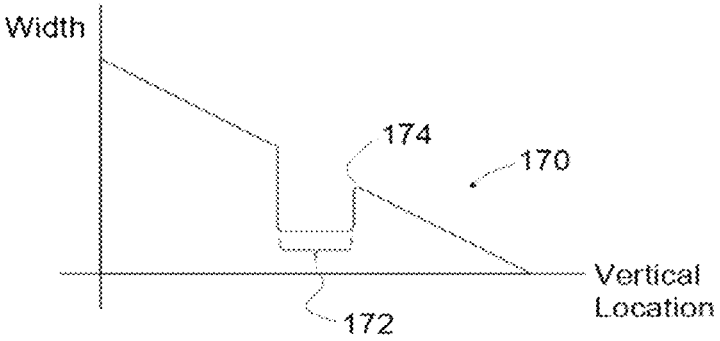

With reference to FIGS. 8A-8C, an example of an asymmetric planar radiator with a downwardly extending protuberance, radiator 150, is discussed. The planar radiator 150 is positioned relative to a pseudo-ground plane 152 and a normal plane 154 so as to be able to assess whether the radiator 150 is asymmetric. In this regard, a pseudo-contact portion 156 of the radiator 150 is positioned to contact the pseudo-ground plane 152. As can be appreciated, the radiator 150 is bilaterally asymmetric relative to the normal plane 154 and, hence, considered to have the asymmetric characteristic. A horizontal line 157 can be drawn through the radiator 150 such that the horizontal line passes through first and second portions of the radiator and a gap 158 between the first and second portions. As such, the radiator 150 has a downwardly extending protuberance. Associated with the downwardly extending protuberance is a member local minimum 160. Further, there is a member inflection point 161 located on the portion of the outer edge located above the horizontal line. With reference to FIG. 8B, due to the presence of the downwardly extending protuberance, the outer edge of the radiator 150 is redefined. More specifically, the outer edge is redefined by drawing a horizontal line 164 through the member local minimum 160 of the protuberance. The horizontal line 164 intersects the outer edge of the radiator at intersection point 166. The portion of the horizontal line extending from the member local minimum 160 to the intersection point 166 replaces the current portion of the outer edge extending between the member local minimum 160 and intersection point 166. This alteration of the outer edge facilitates a determination of whether the wide-narrow-wide and dimensional characteristics are present in the radiator 150. With reference to FIG. 8C, a width profile 170 for the radiator 150 with the modified outer edge is shown. The width profile 170 has an indefinite profile local minimum in area 172 and a profile local maximum 174. The width profile 170 satisfies the wide-narrow-wide characteristics and the vertical characteristic. As can be appreciated from FIGS. 7A-7C, the width profile 170 can be modified by filtering to facilitate the determination of whether the horizontal dimensional characteristic is present.

There is another group of asymmetric planar radiators with shapes that, when combined with the other element(s) needed to form a monopole or dipole antenna, result in an antenna with the noted performance but render assessment of whether the radiator shape satisfies the wide-narrow-wide characteristic problematic. The feature common to this group of asymmetric radiator shapes is two or more upwardly (away from the pseudo-ground plane) extending protuberances. Characteristic of such protuberances is that a horizontal line (i.e., a line parallel to the pseudo-ground plane) can be drawn that passes through a first portion of the radiator, a second portion of the radiator, and a gap between the first and second portions of the radiator. Further, there is a member inflection point on the outer edge that is located below the horizontal line and on the portion of the outer edge that is between the two points at which the horizontal line intersects the outer edge to span the gap. In this case, the member inflection point has zero slope, space above and immediately adjacent to the inflection point, a portion of the radiator located below the inflection point, and the outer edge extends upwardly (away from the pseudo-ground plane) on both sides of the inflection point. Further, there is a member local maximum associated with each protuberance. A member local maximum is characterized by a zero slope and space immediately adjacent to and above the local maximum. Further, the portion of the edge to one side of the member local maximum has a positive slope and the portion of the edge to the other side of the member local maximum has a negative slope.

The problem in assessing the wide-narrow-wide characteristic in asymmetric planar radiators that have upwardly extending protuberance is addressed by splitting the radiator into two or more radiator elements and analyzing the elements to determine if one of the two or more elements satisfies the wide-narrow-wide and dimensional characteristics. The splitting into elements is achieved by horizontal shading, which can be conceptualized as drawing horizontal lines beginning at a member local maximum and proceeding towards the pseudo-contact point with no gaps in any of the horizontal lines. A width profile is then produced for each of the elements (one element is associated with each member local maximum) and analyzed to determine if the wide-narrow-wide and dimensional characteristics are satisfied. If one element satisfies the wide-narrow-wide and dimensional characteristics, the asymmetrical planar radiator is sufficiently symmetrical to realize the noted operational performance.

Figure 9A:
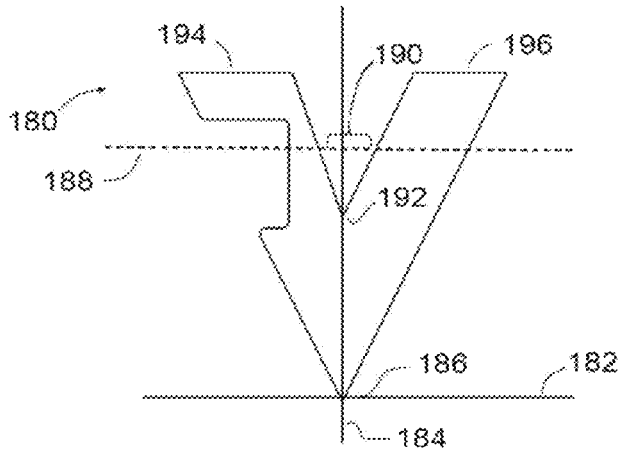
FIG. 9A illustrates an asymmetric planar radiator with an outer edge that has a pair of "stalagmites" that makes problematic the assessment of whether the radiator has a wide-narrow-wide characteristic.
Figure 9B:
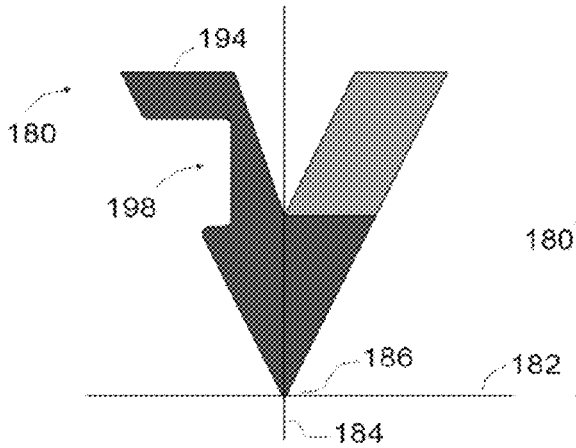
FIGS. 9B and 9C respectively illustrate a first planar element and a second planar element of the asymmetric radiator shown in FIG. 9A.
Figure 9C:
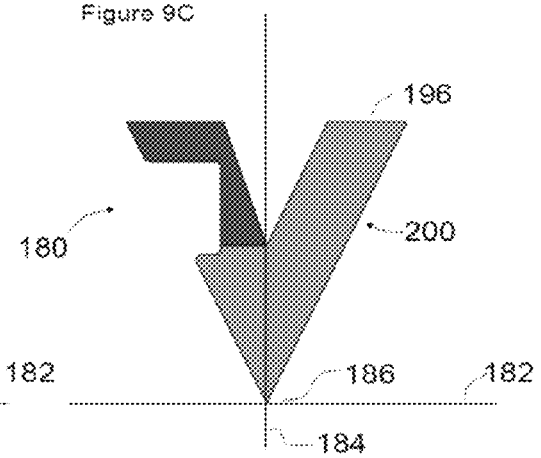
Figure 9D:
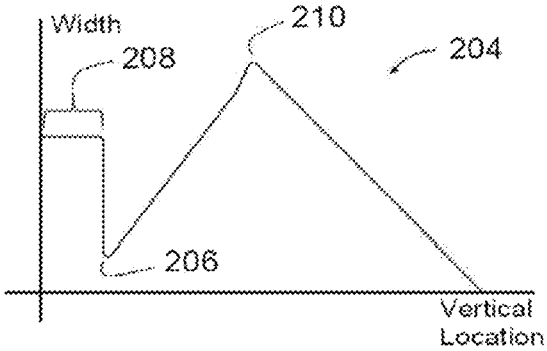
FIGS. 9D and 9E respectively illustrate the width profile for the first radiator element shown in FIG. 9B and the width profile for the second radiator element shown in FIG. 9C.
Figure 9E:
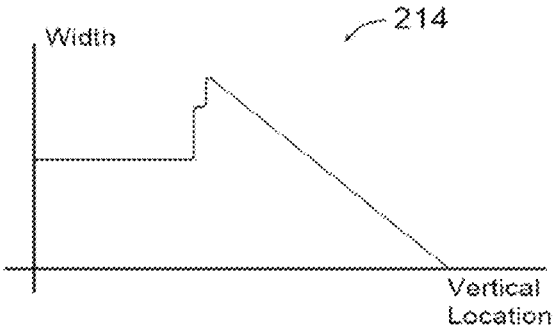

With reference to FIGS. 9A-9E, an example of an asymmetric planar radiator with two upwardly extending protuberances, radiator 180, is discussed. The planar radiator 180 is positioned relative to a pseudo-ground plane 182 and a normal plane 184 so as to be able to assess whether the radiator 180 is asymmetric. In this regard, a pseudo-contact portion 186 of the radiator 180 is positioned to contact the pseudo-ground plane 182. As can be appreciated, the radiator 180 is bilaterally asymmetric relative to the normal plane 184 and, hence, considered to have the asymmetric characteristic. A horizontal line 188 can be drawn through the radiator 180 such that the horizontal line passes through first and second portions of the radiator and a gap 190 between the first and second portions. Further, there is a member inflection point 192 located on the portion of the outer edge located that is between the points at which the horizontal line 188 intersects the outer edge in spanning the gap 190. As such, the radiator 180 has at least two upwardly extending protuberances. Further, there radiator 180 has two member local maximums, namely, a first member local maximum 194 and a second member local maximum 196. With reference to FIG. 9B, a first radiator element 198 is identified by horizontal shading (dark) commencing at the first member local maximum 194 and proceeding to the pseudo-contact portion 186. With reference to FIG. 9C, a second radiator element 200 is identified by horizontal shading (light) commencing at the second member local maximum 196 and proceeding to the pseudo-contact portion 186. With reference to FIG. 9D, the first radiator element has a width profile 204 that has a profile local minimum 206, an indeterminate profile local maximum in area 208 (due to a right angle corner in the outer edge), and a profile local maximum 210. The width profile 204 satisfies the wide-narrow-wide characteristic due to the local minimum 206 being located between two local maximums. Further, the vertical distance between the profile local minimum 206 and the indeterminate profile maximum 208 can be determined. However, it appears that the horizontally closer profile local maximum to the profile local minimum 206 will be the indeterminate profile local maximum in area 208. To determine this "indeterminate" profile local maximum, the profile 204 can be filtered, an example of which was discussed with respect to FIGS. 5A-5C. With reference to FIG. 9E, the second radiator element 200 has a width profile 214. The width profile 214 does not satisfy the wide-narrow-wide characteristic.

There is a group of asymmetric planar radiators with shapes that, when combined with the other element(s) needed to form a monopole or dipole antenna, result in an antenna with the noted performance but render assessment of whether the radiator shape satisfies the wide-narrow-wide characteristic and/or dimensional characteristics problematic. Characteristic of this group of radiators is that the outer edge of the radiator has one or more features that require two of more: (a) filtering due to the presence of one or more high frequency features, (b) redefinition of the outer edge due to the presence of one or more downwardly extending protuberances; and (c) splitting into two or more radiation elements due to the presence of two or more upwardly extending protuberances. The possible combinations are: (1) a shape with one or more downwardly extending protuberances and one or more high frequency features, (2) a shape with two or more upwardly extending protuberances and one or more high frequency features (3) a shape with two or more upwardly extending protuberances and one or more downwardly extending protuberances, and (4) a shape with two or more upwardly extending protuberances, one or more downwardly extending protuberances, and one or more high frequency features. Generally, any such outer edge shape can be analyzed to produce an assessment width profile by: (a) first, redefining the outer edge to address any downwardly extending protuberances, (b) second, identifying any radiation elements attributable to two or more upwardly extending protuberances, and (c) third, filtering the width profile for the redefined outer edge resulting from step (a) (there were no radiation elements identified) to remove high frequency effects or filtering the width profile for one or more of the radiation elements identified in step (b) (there may or may not have been any downwardly extending protuberances) to remove high frequency effects. In this regard, to facilitate the descriptions of features that relate to the performance characteristics and the features of the radiator that require some kind of modification to facilitate the assessment of whether the radiator possesses the features that provide the operational performance, the exemplary outer edge shapes discussed thus far have been relatively simple. It should, however, be appreciated that very complex shapes may also provide the noted operational performance and require numerous modifications of the outer edge or a width profile to produce an assessment width profile that can be used to determine whether the shape is sufficiently asymmetric.

Figure 10:
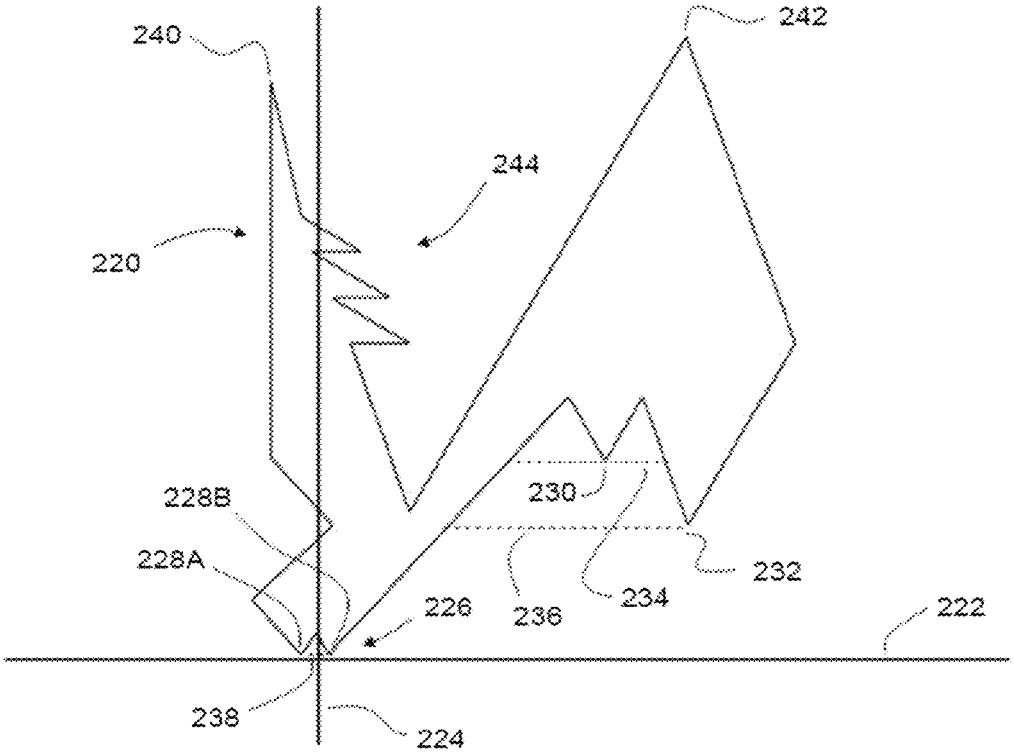
FIG. 10 illustrates an asymmetric planar radiator with an outer edge with a shape that requires redefining the boundary to address multiple downward protuberances, identifying radiation elements, and filtering the width profile associated with at least one of the radiation elements.

With reference to FIG. 10, an example of a relatively complex asymmetric planar radiator 220 is described. The radiator 220 is positioned relative to a pseudo-ground plane 222 and a normal plane 224 so as to be able to assess whether the radiator 220 is asymmetric. In this regard, a pseudo-contact portion 226 comprised of points 228A, 228B, which are separated from one another, is positioned to contact the pseudo-ground plane 222. As can be appreciated, the radiator 220 is bilaterally asymmetric relative to the normal plane 224 and, hence, considered to have the asymmetric characteristic. Further, the radiator 220 has member local minimums 230, 232. Further, points 228A, 228B are each member local minimums. A horizontal line 234 crosses two gaps, one on each side of the member local minimum 230. The horizontal line 234 would redefine the outer edge of the radiator but for the presence of the member local minimum 232. To elaborate, a horizontal line 236 extending from the member local minimum 232 is closer to the pseudo-ground plane 222 and supercedes the horizontal line 234. A horizontal line 238 extends between the points 228A, 228B and redefines that portion of the outer edge of the radiator 220. Moreover, the horizontal line 238 redefines the pseudo-contact portion of the outer edge. The normal plane 224 passes through the mid-point of the horizontal line 238. The outer edge of the radiator 220 also has two member local maximums 240, 242. As such, there will be two radiator elements associated with the radiator. The radiator element associated with the member local maximum 240 will have a width profile with high frequency components due to the presence of the "teeth" structure 244. Consequently, the width profile associated with that element will likely need to be modified by filtering to assess whether the element satisfies the wide-narrow-wide characteristic and the dimensional characteristics. The width profile for the radiator element associated with the member local maximum 242 does not appear likely to require filtering. Further, it appears that the width profile associated with at least one of the two radiator elements will satisfy the wide-narrow-wide test. Whether the dimensional characteristics are present will require careful analysis of the width profile and be dependent upon the value of $\lambda_{low}$.

Figure 11:
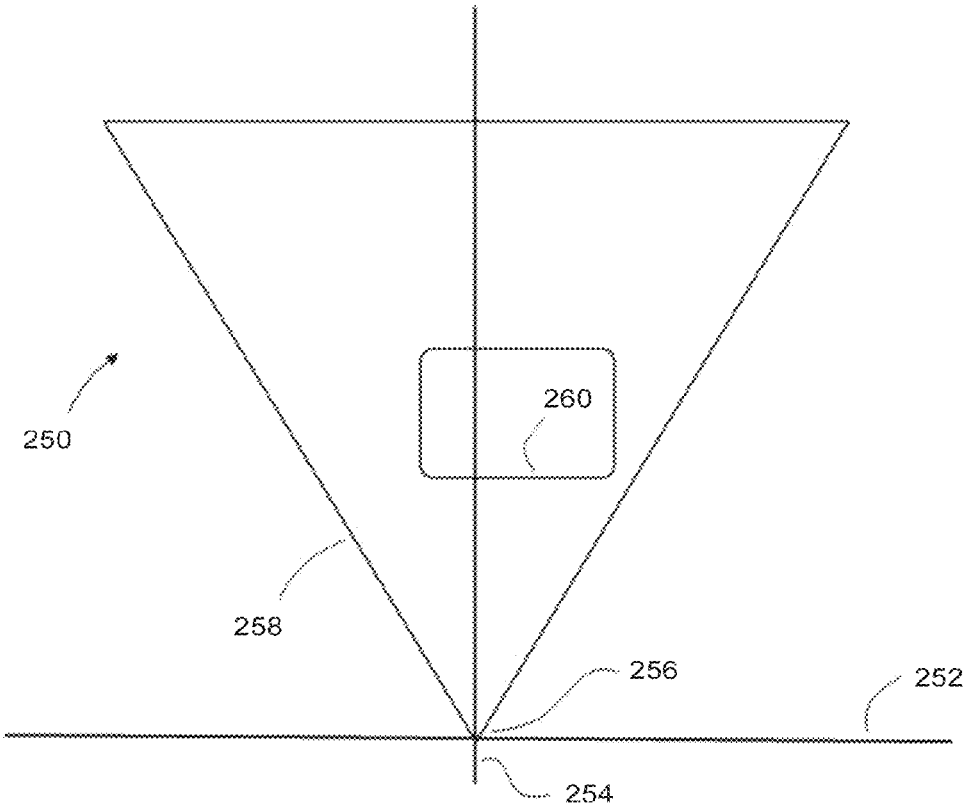
FIG. 11 illustrates an asymmetric planar radiator in which the asymmetry is attributal to an inner edge that defines a void.

Thus far, the exemplary asymmetric planar radiators that have been described have been assessed with respect to features associated with the outer edge of the radiator. None of the exemplary radiators had an inner edge that defined a void. With respect to outer edge assessments, any void defined by the radiator is treated as if the void was "filled in" or not present. It should, however, be appreciated that an asymmetric planar radiator can be asymmetric due to the presence of a void. Further, many such asymmetric planar radiators are capable of operating to facilitate the noted performance. With reference to FIG. 11, an example of an asymmetric planar radiator in which the asymmetry is attributable to a void (radiator 250) is discussed. The radiator 250 is positioned relative to a pseudo-ground plane 252 and a normal plane 254 so as to be able to assess whether the radiator 250 is asymmetric. In this regard, a pseudo-contact portion 256 is positioned to contact the pseudo-ground plane 252. As can be appreciated, the radiator 250 is bilaterally asymmetric relative to the normal plane 254. However, the asymmetry is attributable to a void. To elaborate, the radiator 250 has an outer edge 258 that is an equilateral triangle and an inner edge 260 with a rectangular shape that defines a void and is offset relative to the normal plane 254. Because the outer edge 258 is an equilateral triangle that is bisected by the normal plane 254, the outer edge 258 is not determinative of the asymmetry of the radiator 250. Rather, asymmetry is attributable to the inner edge 260. Assessment of whether a radiator has sufficient asymmetry when the focus is on one or more voids, proceeds in a similar but somewhat different fashion than with the outer edge assessment. To elaborate, the assessment of whether an asymmetric radiator with an asymmetric void is sufficient for realizing the noted performance is done by producing a width profile in which the presence of the void is not ignored. In this case, the width at a vertical location at which a horizontal line passes through the void is the sum of the "sub-widths" of the portions of the radiator present on each side of the void. The width profile is assessed to determine whether the noted wide-narrow-wide and dimensional characteristics are present.

Figure 12:
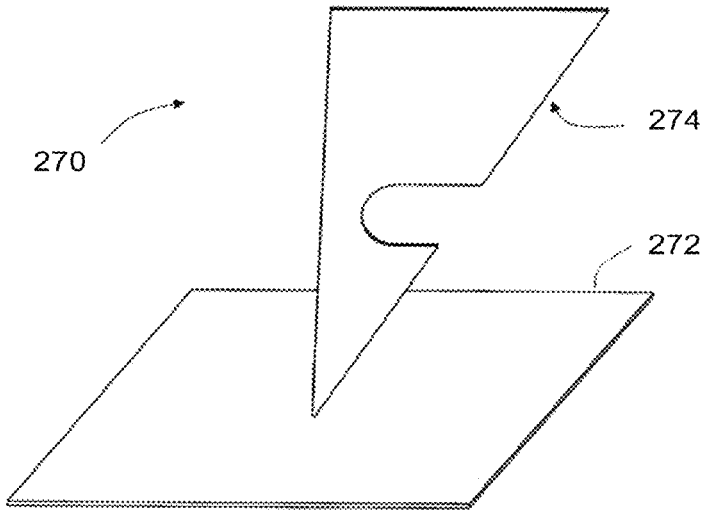
FIG. 12 illustrates a monopole antenna that employs a single asymmetric planar radiator.

FIG. 12 illustrates an example of a monopole antenna 270 comprised of a ground plane 272 and an asymmetric planar radiator 274 that is disposed substantially perpendicular to but separated from ground plane 272. In operation, the monopole antenna 270 operates, substantially as a consequence of the asymmetric planar radiator 274, to have the noted performance characteristics of: (a) at least a 3:1 bandwidth, (b) a VSWR of less than about 3:1 over the bandwidth, (c) vertical polarization, and (d) a relatively constant gain perpendicular or broad-side to the plane of the radiator.

Figure 13:
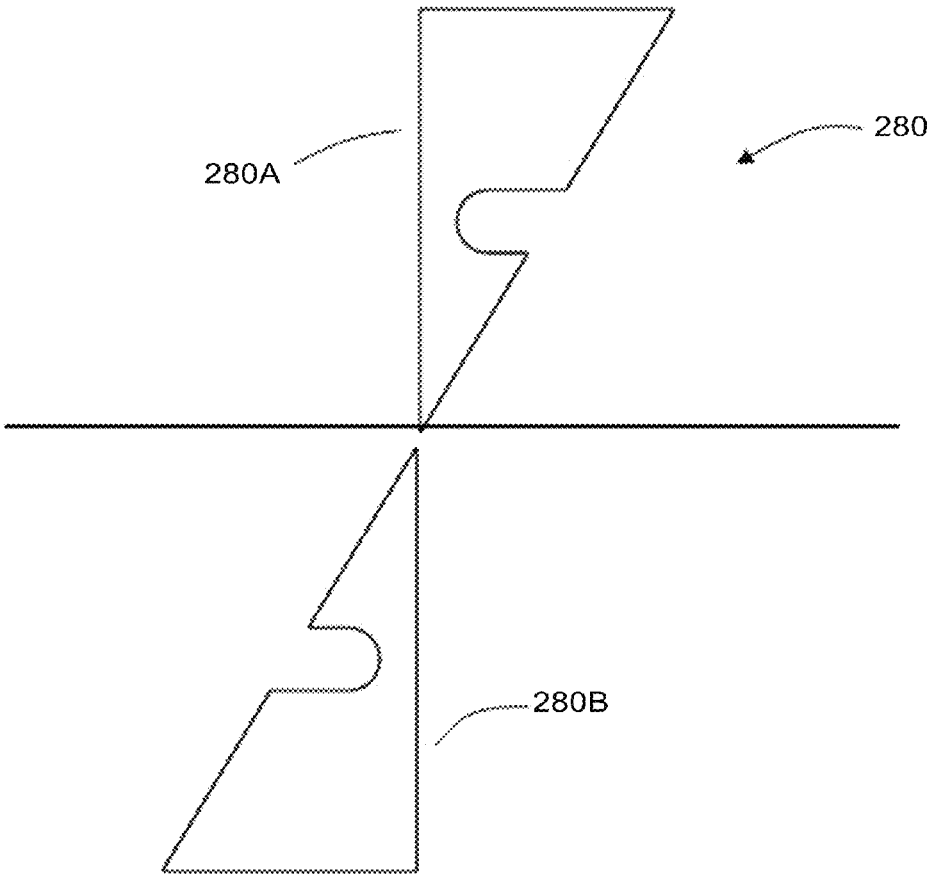
FIG. 13 illustrates a dipole antenna that employs two asymmetric planar radiators.

FIG. 13 illustrates an example of a dipole antenna 280 comprised of first and second asymmetric planar radiators 280A, 280B, which are substantially coplanar. The radiators 280A, 280B are positioned with respect to one another in a "mirrored-flipped" relationship. It is also possible for the radiators 280A, 280B to have a "mirrored" relationship to one another. In operation, the monopole antenna 280 operates, substantially as a consequence of the asymmetric planar radiator 280A, 280B, to have the noted performance characteristics of: (a) at least a 3:1 bandwidth, (b) a VSWR of less than about 3:1 over the bandwidth, (c) vertical polarization, and (d) a relatively constant gain perpendicular or broad-side to the plane of the radiator.

Figure 14A:
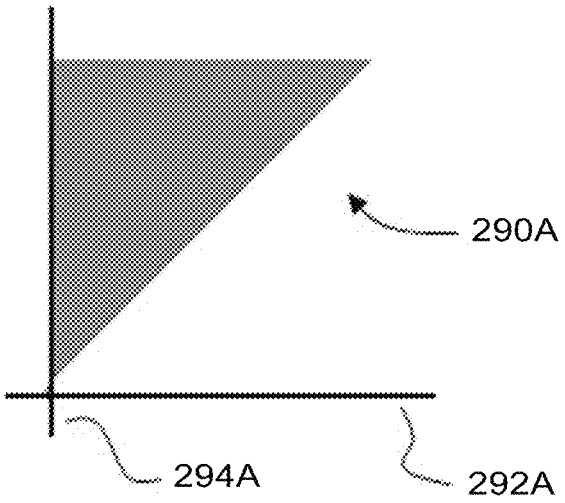
FIGS. 14A and 14B respectively illustrate a reference asymmetric planar radiator that does not achieve the desired operational performance and an improved asymmetric planar radiator that does achieve the desired operational performance.
Figure 14B:
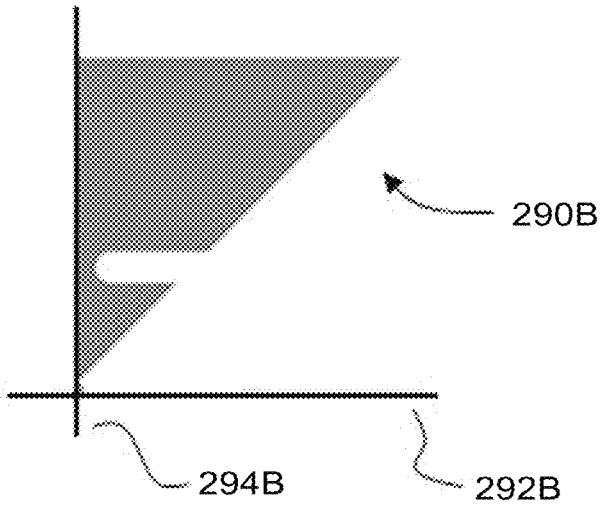

With reference to FIGS. 14A and 14B, a reference asymmetric planar radiator 290A and an improved asymmetric planar radiator 290B as described herein are discussed. The radiator 290A is positioned perpendicular to a pseudo-ground plane 292A and a normal plane 294A. From this positioning, it can be seen that radiator 290A is asymmetrical. The radiator 290B is positioned perpendicular to a pseudo-ground plane 292B and a normal plane 294B. From this positioning, it can be seen that radiator 290B is also asymmetrical. However, it should be appreciated that the radiator 290B is significantly more asymmetric than radiator 290A due to the presence of a slot. Further, radiator 290A does not meet the wide-narrow-wide characteristic. In contrast, radiator 290B does meet the wide-narrow-wide characteristic and also meets the dimensional characteristics.

Figure 15A:
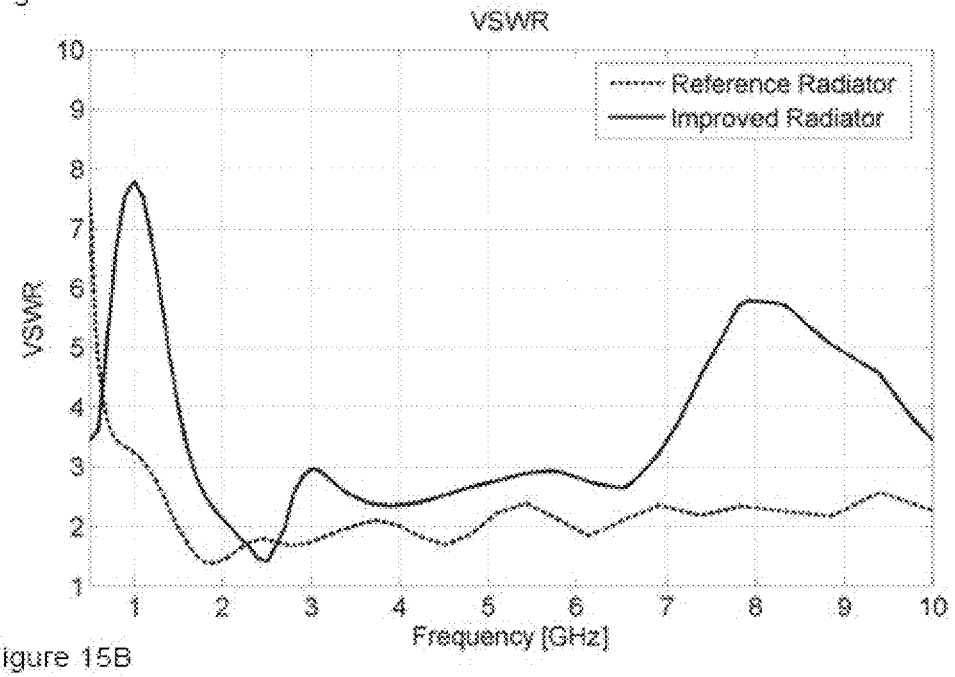
FIGS. 15A and 15B respectively show the VSWR and the swept gain over frequency for the direction perpendicular to the plane of the radiator for the reference and improved asymmetric planar radiators shown in FIGS. 14A and 14B.
Figure 15B:
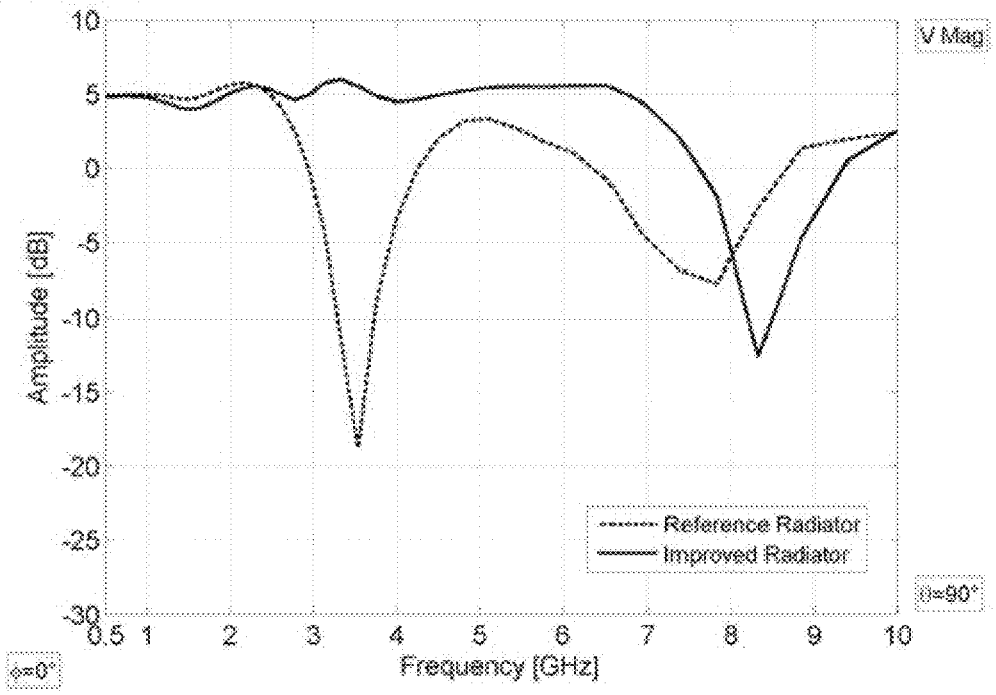
Figure 16A:
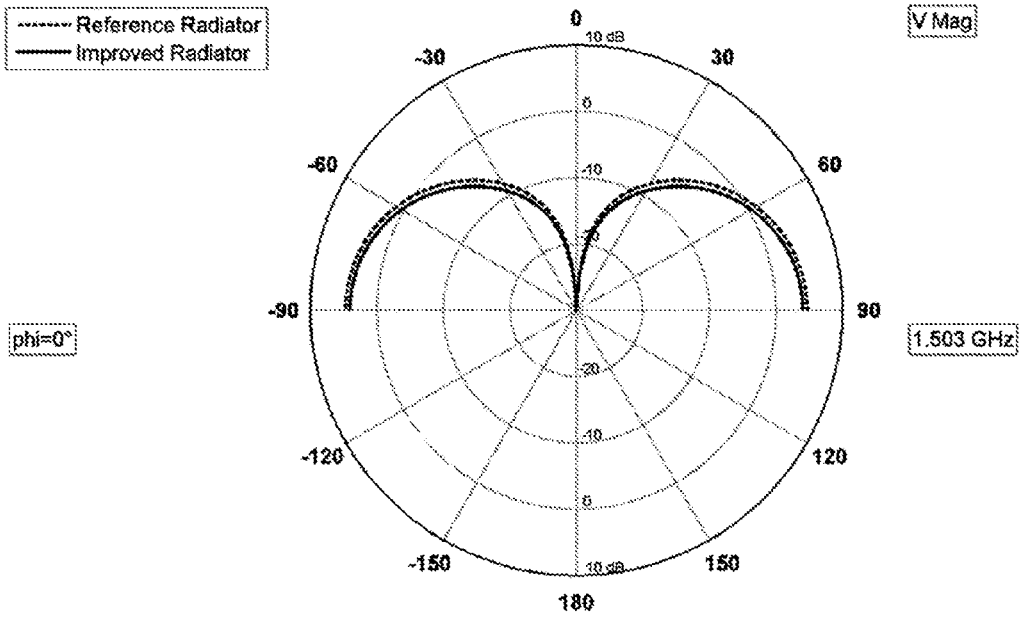
FIGS. 16A-16L respectively show elevation plane patterns perpendicular to the plane of the radiator for frequencies covering the operating band.
Figure 16B:
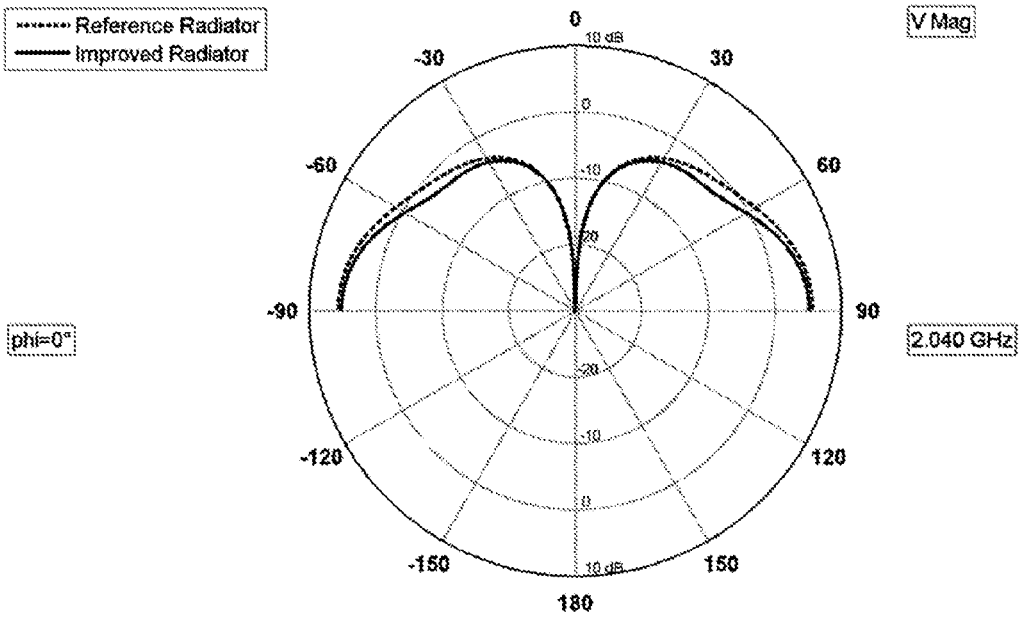
Figure 16C:
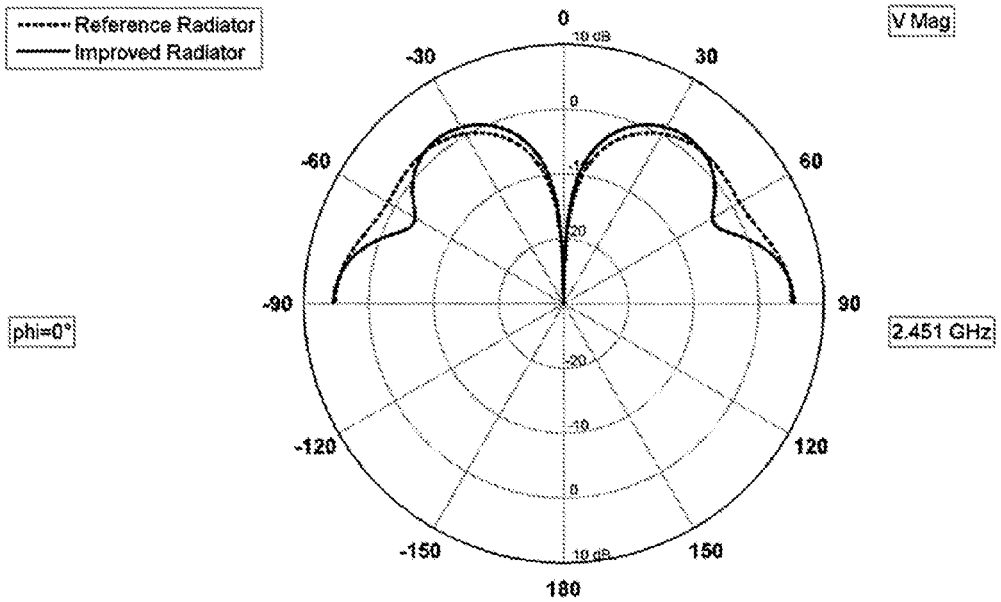
Figure 16D:
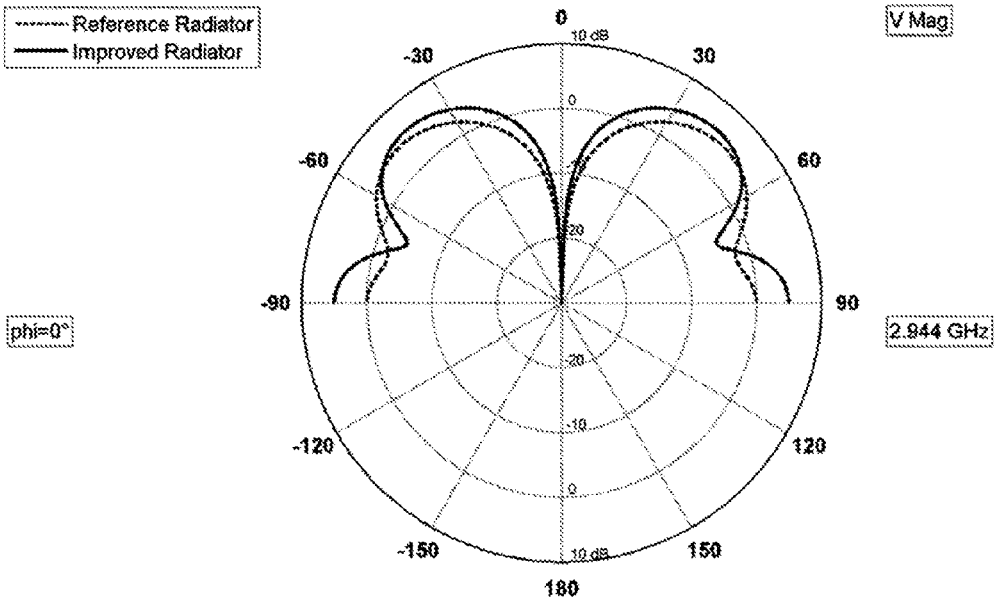
Figure 16E:
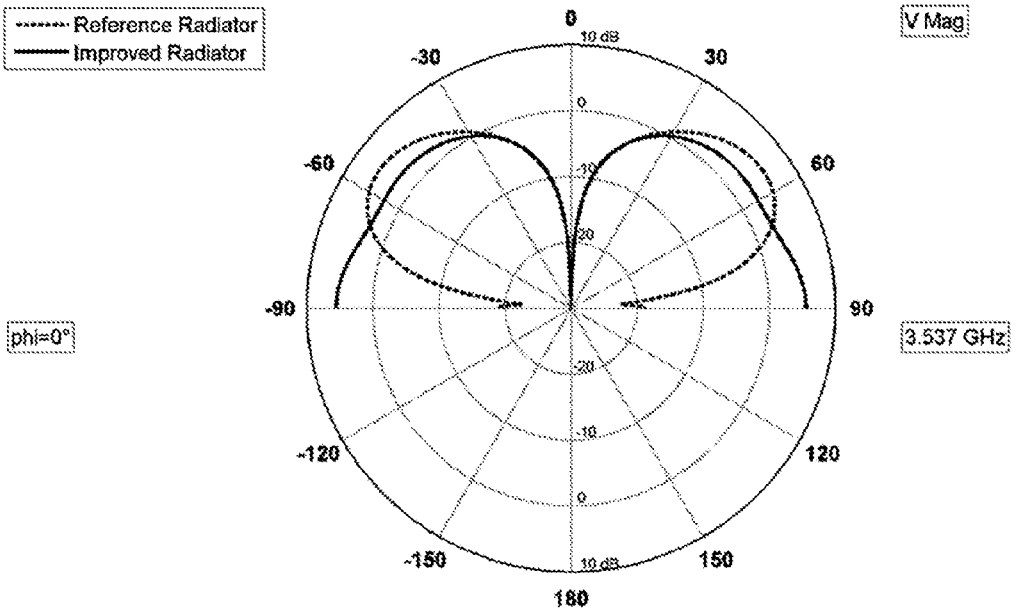
Figure 16F:
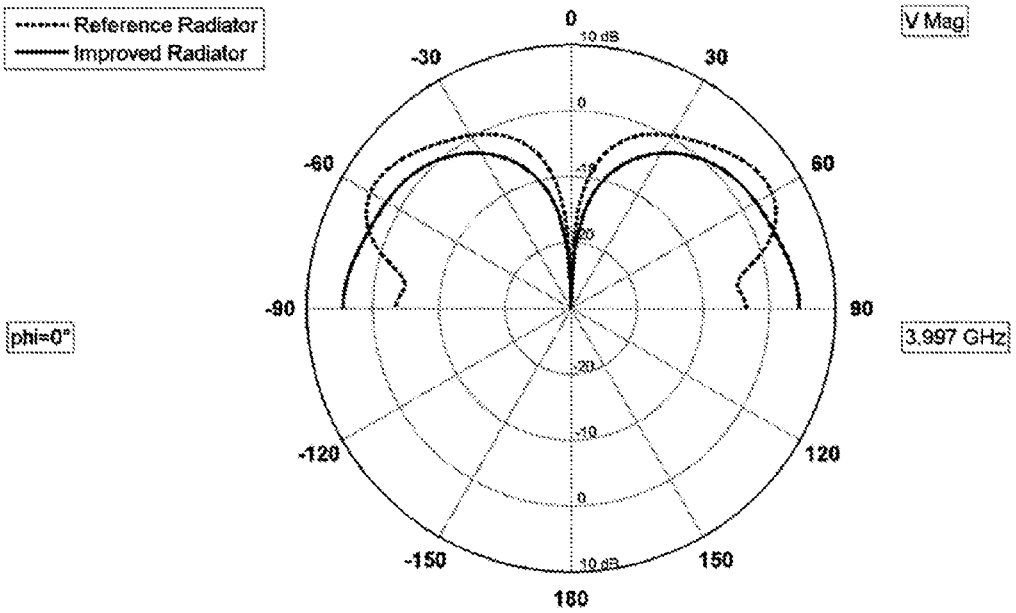
Figure 16G:
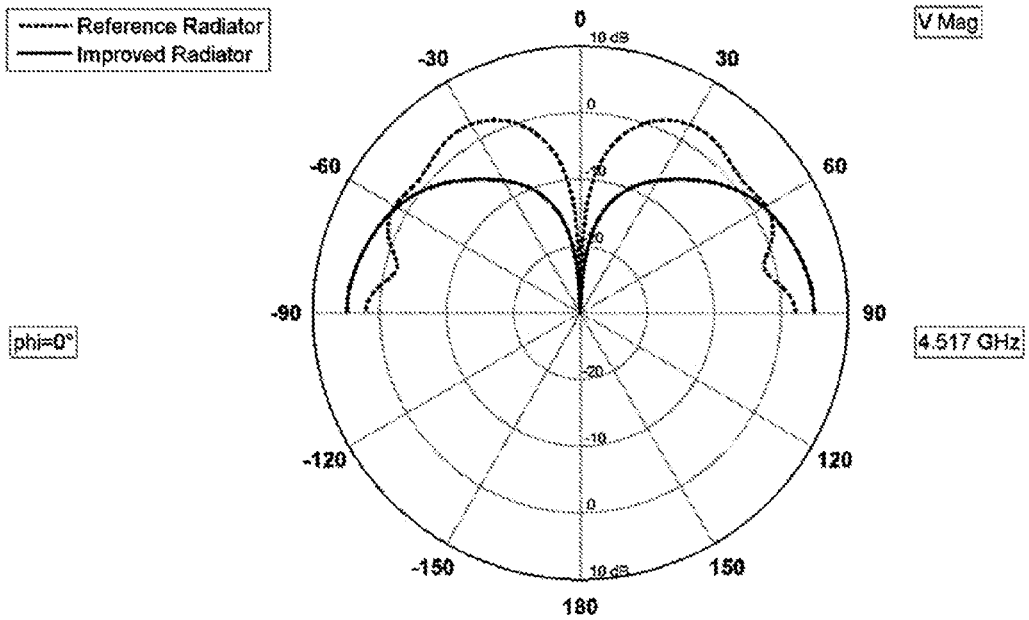
Figure 16H:
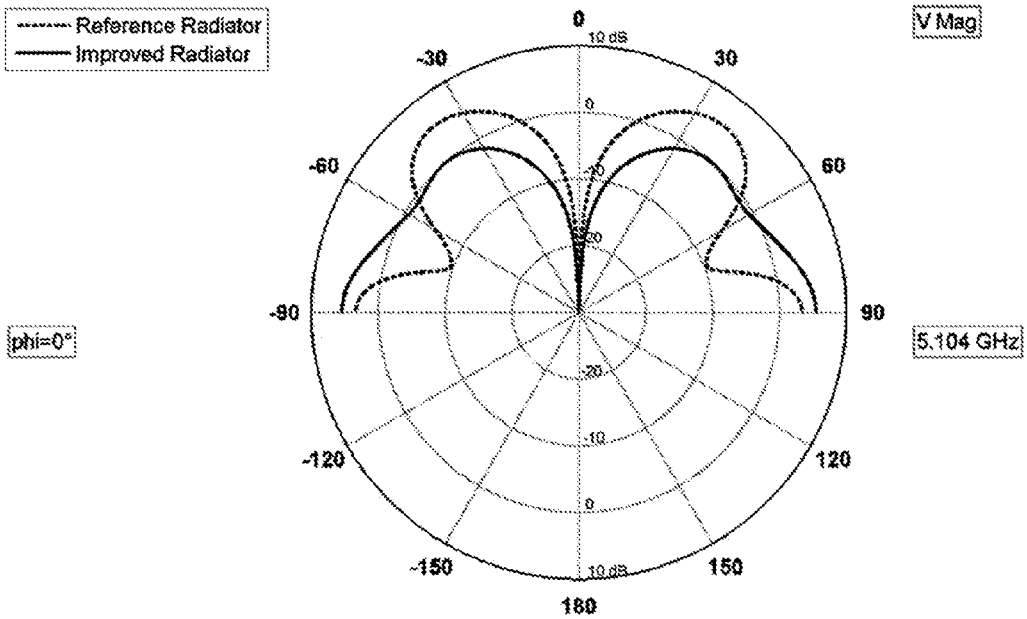
Figure 16I:
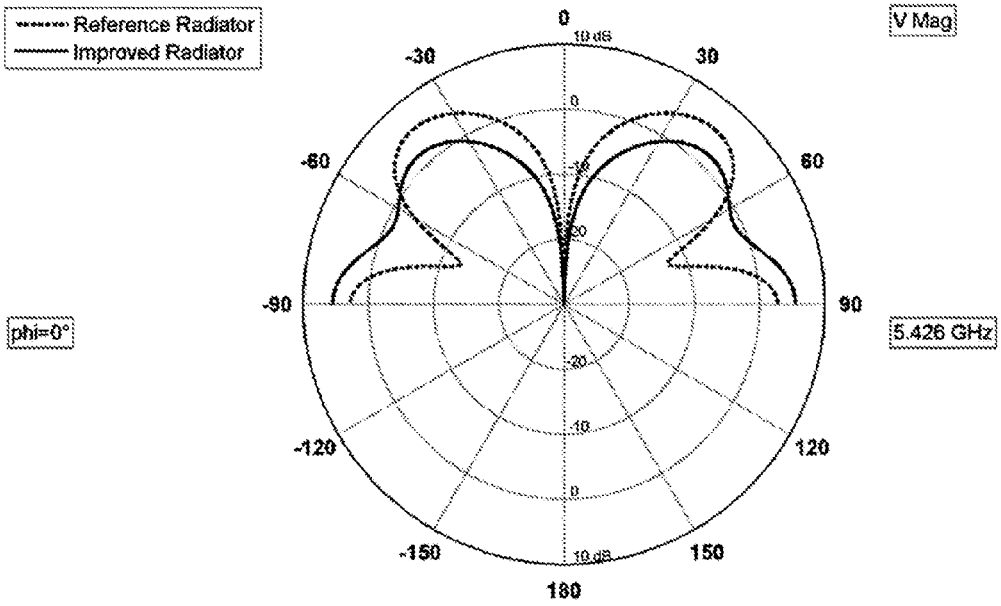
Figure 16J:
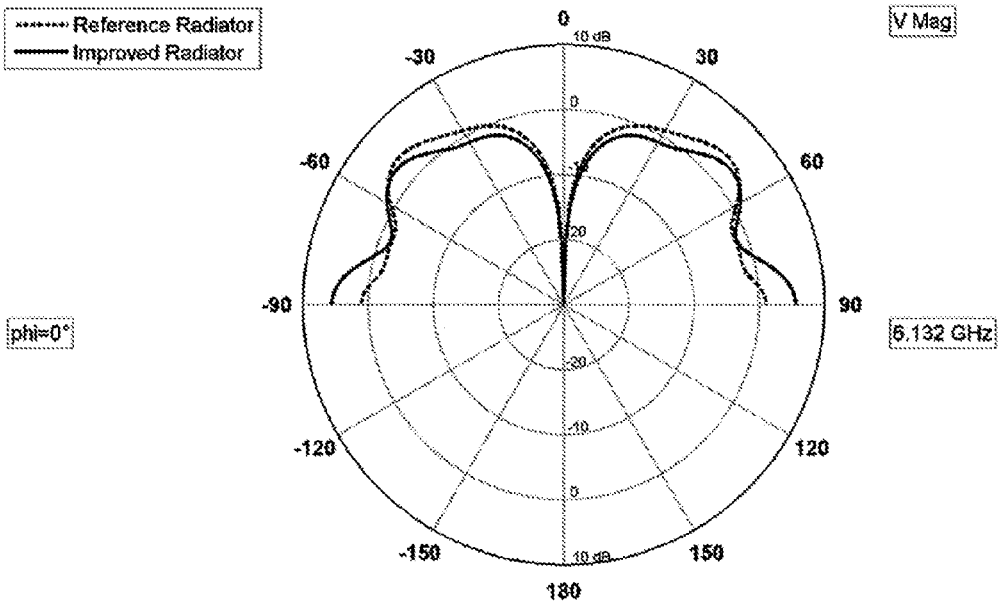
Figure 16K:
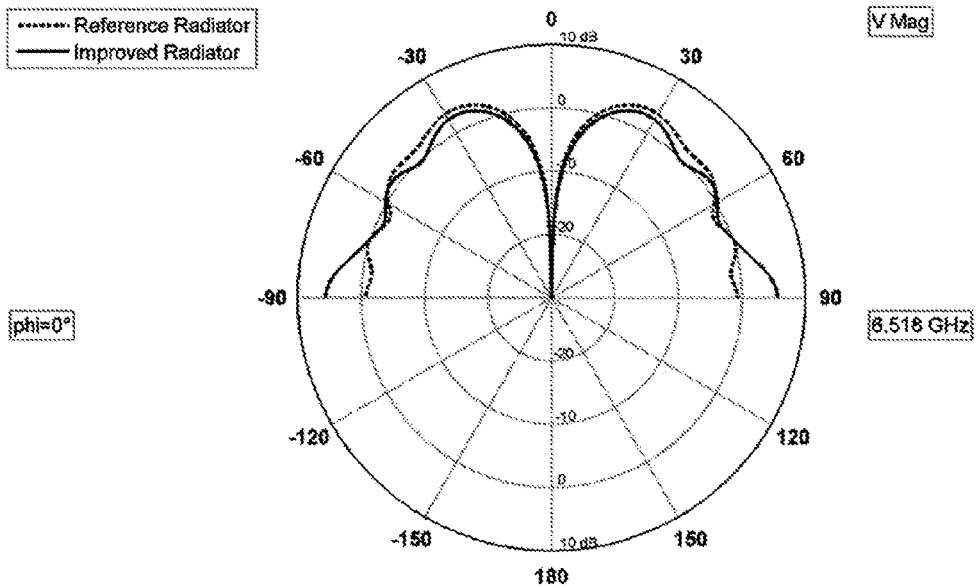
Figure 16L:
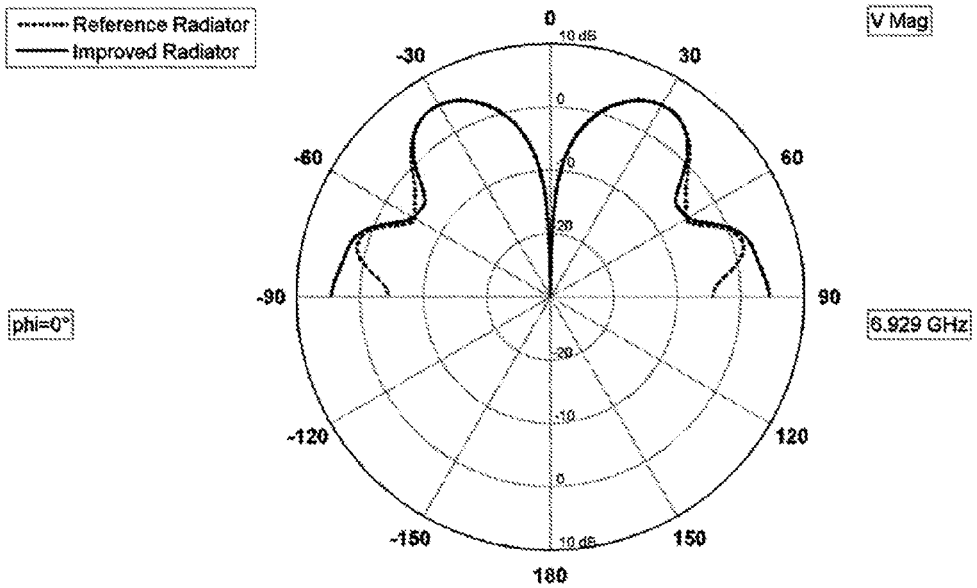

In FIG. 15A, it can be seen that both radiators 290A and 290B show a VSWR of less than 3:1 over the operating frequency band, which is also greater than 3:1. In this case, the operating frequency band extends approximately from 1.5 GHz to about 7.0 GHz. With respect to FIG. 15B, the swept gain at the point perpendicular to the plane of the radiators 290A, 290B is shown. The radiator 290A shows a significant gain drop-out at approximately 3.5 GHz and the gain never returns to the initial gain level present below the drop-out in frequency. In contrast, radiator 290B shows a substantially constant gain over the entire frequency band, thereby avoiding the gain drop-out experienced with radiator 290A. With reference to FIGS. 16A-16L, the elevation pattern in the plane perpendicular to the planes of radiators 290A, 290B are shown at various frequencies in the operating frequency band. The elevation patterns for the reference radiator 290A are identified with dashed lines. The elevation patterns for the improved radiator 290B are identified with solid lines. From FIG. 16E, the drop-out in gain at ±90° angles is apparent for the reference radiator 290A. In contrast, the improved radiator 290A does not show any such drop-out in gain. FIGS. 16F-16H, illustrate that the reference radiator 290A never achieves the gain of the improved radiator 290B at the same ±90° angles.

The foregoing description of the invention is intended to explain the best mode known of practicing the invention and to enable others skilled in the art to utilize the invention in various embodiments and with the various modifications required by their particular Applications or uses of the invention.

What is claimed is:

1. A radiator structure having, when used operatively, a relatively stable impedance and radiation pattern over a wide bandwidth comprising:

a planar radiator that has a outer edge;

the outer edge having a pseudo-contact portion;

wherein, when the planar radiator is positioned:

(a) perpendicular to a pseudo-ground plane;

(b) perpendicular to a normal plane that is perpendicular to the pseudo-ground plane;

(c) such that only the pseudo-contact portion contacts the pseudo-ground plane;

(d) such that the normal plane intersects a midpoint of the pseudo-contact portion of the planar radiator;

(e) such that the planar radiator, other than the pseudo-contact portion of the planar radiator, is entirely located to one side of the pseudo-ground plane; and (f) such that the planar radiator is oriented relative to the pseudo-ground plane as the planar radiator would be oriented, if used in a monopole antenna, relative to an idealized infinite ground plane;

the planar radiator is bilaterally asymmetric relative to the normal plane; and wherein, when the planar radiator is part of one of a monopole antenna and dipole antenna and being fed so as to transmit/receive an electromagnetic signal, the antenna:

(a) operates over a bandwidth in which the ratio of the highest frequency ($f_{high}$) in the bandwidth to the lowest frequency ($f_{low}$) in the bandwidth is at least 3:1;

(b) has a continuous VSWR of less than about 3:1 over the bandwidth;

(c) is vertically polarized; and (d) has a relatively constant gain perpendicular to the plane of the radiator such that any dropouts over the bandwidth are less than 6 dB;

the planar radiator has an assessment width profile that extends from a member local maximum point to the pseudo-contact portion;

wherein the assessment width profile has a profile local minimum point located between a first profile local maximum point and a second profile local maximum point;

wherein the first profile local maximum point is located in a space extending from the profile local minimum point to and including the member local maximum point;

wherein the second profile local maximum point is located in a space extending from the profile local minimum point to and including the pseudo-contact portion;

wherein no other profile local maximum point is located between the profile local minimum point and either the first profile local maximum point or second profile local maximum point;

wherein the profile local minimum point has a zero slope;

wherein each of the first and second profile local maximum points has a zero slope;

wherein the first profile local maximum point, if occurring at the member local maximum point, is immediately followed by a negative slope; and if occurring between the member local maximum point and the profile local minimum point is immediately preceded by a positive slope and immediately followed by a negative slope;

wherein the second profile local maximum point, if occurring at the pseudo-contact portion, is immediately preceded by a positive slope;

if occurring between the profile local minimum point and the pseudo-contact portion is immediately preceded followed by a negative slope;

wherein the vertical distance between the profile local minimum point and the vertically nearer of the first and second profile local maximum points is at least $0.02\lambda_{low}$; and wherein the horizontal distance between the profile local minimum point and the horizontally nearer of the first and second profile local maximum points is at least $0.01\lambda_{low}$.

2. A radiator structure, as claimed in claim 1, wherein:

the assessment width profile is an unprocessed width profile for the planar radiator.

3. A radiator structure, as claimed in claim 1, wherein: the assessment width profile is an unprocessed width profile for the planar radiator that has been filtered so as to pass substantially only a first harmonic of the unprocessed width profile.

4. A radiator structure, as claimed in claim 1, wherein:

the assessment width profile is a width profile for a redefined outer edge of the planar radiator; the outer edge being redefined if (a) a horizontal line passing through the planar radiator passes through a gap, the gap not being caused by a void in the planar radiator, and there is a member local inflection point in the planar radiator above the portion of the horizontal line that passes through the gap and (b) there is at least one member local minimum point in the planar radiator located between a member local maximum point of the planar radiator and the pseudo-contact portion;

the outer edge being redefined such that each horizontal line extending from a member local minimum point in the planar radiator and intersecting the outer edge so as to define a closed area that was previously an open area adjacent to the member local minimum point becomes a portion of a redefined outer edge.

5. A radiator structure, as claimed in claim 1, wherein:

the planar radiator has an assessment width profile that is a filtered width profile for a redefined outer edge of the planar radiator;

the outer edge being redefined if (a) a horizontal line passing through the planar radiator passes through a gap, the gap not being caused by a void in the planar radiator, and there is a local maximum point in the planar radiator above the portion of the horizontal line that passes through the gap and (b) there is at least one member local minimum point in the planar radiator located between a member local maximum point of the planar radiator and the pseudo-contact portion;

the outer edge being redefined such that each horizontal line extending from a member local minimum point in the planar radiator and intersecting the outer edge so as to define a closed area that was previously an open area immediately adjacent to the member local minimum point becomes a portion of a redefined outer edge;

the redefined outer edge having a redefined width profile;

the assessment width profile is a redefined width profile that has been low-pass filtered so as to pass substantially only a first harmonic of the redefined width profile.

6. A radiator structure, as claimed in claim 1, wherein: the planar radiator has multiple assessment width profiles; the multiple assessment width profiles resulting if (a) a horizontal line passing through the planar radiator passes through a gap, the gap not being caused by a void in the planar radiator, and there is a member inflection point below the portion of the horizontal line that passes through the gap, (b) multiple elements are defined by horizontal shading starting at each member local maximum point and extending to the pseudo-contact portion, and (c) each of the multiple elements has an assessment width profile that is a width profile for the element.

7. A radiator structure, as claimed in claim 1, wherein: the planar radiator has multiple assessment width profiles; the planar radiator has a redefined outer edge as set forth in claim 4; the multiple assessment width profiles resulting if (a) a horizontal line passing through the planar radiator passes through a gap, the gap not being caused by a void in the planar radiator, and there is a member local minimum point below the portion of the horizontal line that passes through the gap, (b) multiple elements are defined by horizontal shading starting at each member local maximum point and extending to the pseudo-contact portion, and (c) each of the multiple elements has an assessment width profile that is a width profile for the element; the multiple assessment width profiles are the width profiles for each of the multiple elements.

8. A radiator structure, as claimed in claim 1, wherein: the planar radiator has multiple assessment width profiles; the planar radiator has a redefined outer edge as set forth in claim 4; the planar radiator with a redefined outer edge has multiple elements, each with an element width profile as set forth in claim 6; at least one of the multiple elements has an filtered element width profile that has been processed so as to pass substantially only a first harmonic of the element width profile; the multiple assessment width profiles includes each filtered element width profile and element profile.

9. A radiator structure, as claimed in claim 1, wherein: the planar radiator has multiple assessment width profiles; the planar radiator has multiple elements, each with an element width profile as set forth in claim 6; at least one of the multiple elements has an filtered element width profile that has been processed so as to pass substantially only a first harmonic of the element width profile; the multiple assessment width profiles includes each filtered element width profile and element profile.

10. A radiator structure, as claimed in claim 1, wherein:

the planar radiator has an inner edge that is a closed and defines a void that is completely surrounded by the planar radiator.

11. A radiator structure, as claimed in claim 10, wherein:

the inner edge is bilaterally symmetrical relative to the normal plane; and the outer edge is bilaterally asymmetrical relative to the normal plane.

12. A radiator structure, as claimed in claim 10, wherein:

the inner edge is bilaterally asymmetrical relative to the normal plane; and the outer edge is one of bilaterally symmetrical and bilaterally asymmetrical relative to the normal plane.

13. A radiator structure, as claimed in claim 1, further comprising:

a ground plane located adjacent to but separated from the planar radiator;

wherein the planar radiator and ground plane substantially form a monopole antenna.

14. A radiator structure, as claimed in claim 1, further comprising:

a second planar radiator located adjacent to but separated from the planar radiator;

wherein the planar radiator and second planar substantially form a dipole antenna.

15. A radiator, as claimed in claim 14, wherein:

the second planar radiator is a mirror-image of the planar radiator.

* * * * *

UNITED STATES PATENT AND TRADEMARK OFFICE

CERTIFICATE OF CORRECTION

PATENT NO. : 9,077,075 B1
APPLICATION NO. : 13/662477
DATED : July 7, 2015
INVENTOR(S) : Lalezari et al.

It is certified that error appears in the above-identified patent and that said Letters Patent is hereby corrected as shown below:

In the Specification

At col. 2, line 43, delete "of a combination", and insert --or a combination--.

At col. 11, line 34, delete "0.022λlow", and insert --0.02λlow--.

At col. 18, line 57, delete "Applications", and insert --applications--.

In the Claims

At col. 19, line 62, following "ceded", insert --by a positive slope and immediately--.

Signed and Sealed this
First Day of December, 2015

Michelle K. Lee

Michelle K. Lee
*Director of the United States Patent and Trademark Office*